US008712272B2

(12) United States Patent
Takeuchi et al.

(10) Patent No.: US 8,712,272 B2
(45) Date of Patent: Apr. 29, 2014

(54) IMAGE HEATING APPARATUS

(75) Inventors: Suguru Takeuchi, Toride (JP); Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 128 days.

(21) Appl. No.: 13/307,724

(22) Filed: Nov. 30, 2011

(65) Prior Publication Data

US 2012/0155934 A1 Jun. 21, 2012

(30) Foreign Application Priority Data

Dec. 17, 2010 (JP) ..... 2010-281360

(51) Int. Cl.
*G03G 15/20* (2006.01)

(52) U.S. Cl.
USPC ..... 399/69; 399/329

(58) Field of Classification Search
USPC ..... 399/69, 328, 329
See application file for complete search history.

(56) References Cited

U.S. PATENT DOCUMENTS

| | | | | |
|---|---|---|---|---|
| 7,268,327 | B2 | 9/2007 | Yamamoto et al. | |
| 7,433,639 | B2 * | 10/2008 | Yasuda et al. | 399/329 |
| 7,609,991 | B2 | 10/2009 | Koshida | |
| 7,783,240 | B2 * | 8/2010 | Ito et al. | 399/328 |
| 8,457,539 | B2 * | 6/2013 | Nanjo et al. | 399/328 |
| 8,606,161 | B2 | 12/2013 | Nanjo et al. | |
| 2006/0086726 | A1 | 4/2006 | Yamamoto et al. | |
| 2009/0214243 | A1 * | 8/2009 | Yoda et al. | 399/69 |
| 2010/0028061 | A1 | 2/2010 | Nanjo et al. | |
| 2010/0178088 | A1 | 7/2010 | Koshida et al. | |
| 2011/0076070 | A1 | 3/2011 | Koshida | |
| 2011/0150546 | A1 | 6/2011 | Koshida | |
| 2012/0148318 | A1 * | 6/2012 | Sugaya et al. | 399/329 |
| 2012/0201583 | A1 * | 8/2012 | Takeuchi | 399/335 |
| 2013/0251423 | A1 | 9/2013 | Nanjo et al. | |

FOREIGN PATENT DOCUMENTS

| | | | |
|---|---|---|---|
| CN | 101482727 | A | 7/2009 |
| CN | 101520632 | A | 9/2009 |
| CN | 101546167 | A | 9/2009 |
| CN | 101639640 | A | 2/2010 |
| JP | 2000-181258 | A | 6/2000 |

(Continued)

OTHER PUBLICATIONS

Chinese Office Action dated Dec. 24, 2013, issued in counterpart Chinese Application No. 201110421736.2, and English-language translation thereof.

*Primary Examiner* — David Gray
*Assistant Examiner* — Gregory H Curran
(74) *Attorney, Agent, or Firm* — Fitzpatrick, Cella, Harper & Scinto

(57) ABSTRACT

An apparatus includes a coil generating magnetic flux, a rotatable heater generating heat by the flux generated from the coil, for heating an image on a recording material, magnetic cores provided outside the heater and arranged in a rotational axis direction of the heater, a first mover moving at least a part of the cores from a first position to a second position spaced form the coils, an adjuster, movable between the cores and the heater, for reducing the flux directed from the cores toward the heater, and a second mover moving, when a first core in a non-sheet-passing area of the recording material is moved to the second position by the first mover and a second core adjacent to the first core in the non-sheet-passing area is disposed at the first position to heat the image, the adjuster to a position corresponding to the second core.

9 Claims, 22 Drawing Sheets

(56) References Cited

FOREIGN PATENT DOCUMENTS

| | | | |
|---|---|---|---|
| JP | 2001-194940 A | 7/2001 | * cited by examiner |
| JP | 2006-120523 A | 5/2006 | |
| JP | 2010-160388 A | 7/2010 | |

(a)

A-A (b)

A-A

IMAGE HEATING APPARATUS

FIELD OF THE INVENTION AND RELATED ART

The present invention relates to an image heating apparatus for use with an image forming apparatus such as a copying machine and a printer. Examples of the image heating apparatus may include a fixing device for fixing an unfixed image formed on a recording material, a gloss-imparting device for improving glossiness of an image by heating the image fixed on the recording material, and the like.

In a conventional electrophotographic copying machine or the like, the fixing device as the image heating apparatus for melt-fixing a toner (developer) on the recording material, which is a conveyed recording medium, by fusing the toner, by heat, of a toner image (unfixed image) transferred onto the recording material is provided.

With respect to this fixing device, in order to realize a high-speed temperature rise, there have been known those in which a fixing roller as a heating member is formed with a small thickness and a small diameter, in which a heating member is press-contacted to a rotatable member of a resin film from an inside of the rotatable member and in which a thin metal rotatable member is heated through induction heating. In either of these fixing devices, the thermal capacity of the rotatable member as a heating medium is decreased, and thus is intended to be heated by a heat source with a good heating efficiency. Further, the fixing device using a non-contact heat source is also known, but from the viewpoints of cost and energy efficiency, in the image forming apparatus such as the copying machine, many proposals of the fixing device of the type in which the developer on the recording material is heat-melted by bringing the thin rotatable member into contact with the recording material have been made.

However, in the case where the thin rotatable member is used as the heating medium in order to decrease the thermal capacity, the cross-sectional area of a cross section perpendicular to an axis of the rotatable member is very small, and therefore the heat transfer efficiency with respect to an axial direction is not good. This tendency is conspicuous with a smaller thickness, so that when a material such as a resin material or the like with a low thermal conductivity is used, the heat transfer efficiency is further lowered.

This is also clear from the Fourier's law such that a heat quantity Q transmitted per unit time is, when a temperature difference between two point is $\theta 1-\theta 2$ and a length between the two points is L, represented by the following formula:

$$Q=\lambda\times f(\theta 1-\theta 2)/L.$$

This is of no problem in the case where the recording material having a length equal to the length of the rotatable member with respect to a longitudinal direction (rotational axis direction), i.e., the recording material with a maximum sheet-passing width, is subjected to sheet passing and fixing. However, in the case where a small-sized recording material with a narrow width is continuously subjected to sheet passing, there arose a problem such that the temperature of the rotatable member in a non-sheet-passing area was increased to a value higher than a target (control) temperature to result in a very large difference between the temperature in a sheet-passing area and the temperature in the non-sheet-passing area.

Therefore, due to such temperature non-uniformity of the heating medium, there is a possibility that the heat lifetime of a peripheral member of a resin material is lowered and that the peripheral member is thermally damaged.

Further, there also arises a problem that there is a possibility that a paper crease, skew, and the like and fixing non-uniformity occur due to partial temperature non-uniformity. Such a temperature difference between the sheet-passing area and the non-sheet-passing area is widened with a larger thermal capacity of the recording material to be conveyed and with a higher throughput (print number per unit time). For this reason, in the case where the image heating apparatus was constituted by a thin rotatable member with low thermal capacity, it was difficult to apply the image heating apparatus to a copying machine or the like with the high throughput.

Incidentally, in the image heating apparatus using a halogen lamp and a heat-generating resistor as the heating source, the type in which the heating source is divided to selectively effect energization so as to heat an area corresponding to a sheet-passing width has been known. Further, in the image heating apparatus using an induction coil as the heating source, there is the type in which the heating source is similarly divided to selectively effect energization.

However, when the heating source is provided in plurality or divided, the control circuit is complicated, which increases the cost correspondingly. Further, when the heating source is intended to contact the recording materials with various widths, the number of divisions is further increased to result in a further high cost. In addition, when the thin rotatable member is used as the heating medium, the temperature distribution in the neighborhood of a boundary in the case of the division is discontinuous and non-uniform, so that there is a possibility that the fixing performance is adversely affected.

In order to solve these problems, it is known to use an image heating apparatus of an electromagnetic-induction-heating type in which in order to meet various recording-material sizes, a magnetic core is divided with respect to a direction perpendicular to a recording-material conveyance direction and is movable by a moving means so as to be changed in movement distance depending on the recording-material size (Japanese Laid-Open Application (JP-A) 2001-194940).

By the image heating apparatus, the distance between an induction heating source and the magnetic core is increased in the non-sheet-passing area, and therefore the efficiency of a magnetic circuit formed by the magnetic core and the heating medium at a periphery of the induction heating source is lowered, so that the heat-generation amount is lowered. That is, non-sheet-passing-area temperature rise is avoided and as a result, an abnormal temperature rise of the magnetic core and the induction heating source is also avoided. Further, in order to meet the respective recording-material sizes, the movement distance is changed depending on the recording-material size, so that the non-sheet-passing-area temperature rise can be prevented even with respect to the respective recording-material sizes.

However, in the above-described image heating apparatus of the electromagnetic induction heating type, the following problem arises. A positional relationship between the recording material and the magnetic core divided with respect to the direction perpendicular to the recording-material conveyance direction is not satisfied and when the heating area is larger than the recording-material size, a temperature rise occurs at the non-sheet-passing portion. Further, even when the positional relationships between the recording material and the magnetic core divided with respect to the direction perpendicular to the recording-material conveyance direction is satisfied, the temperature rise occurs at both end portions (edge portions) of the recording material. This is because a sufficient heat-generation amount sufficient to fix the toner is required at the recording-material end portions, but the heat quantity taken by the recording material at the recording-material end portions is smaller with sheet passing than that in the sheet-passing area, so that overheating occurs.

SUMMARY OF THE INVENTION

A principal object of the present invention is to provide an image heating apparatus capable of reducing a degree of overheating occurring in a non-sheet-passing area with sheet passing.

According to an aspect of the present invention, there is provided an image heating apparatus comprising: a coil for generating magnetic flux; a rotatable heat-generating member, which generates heat by the magnetic flux generated from the coil, for heating an image on a recording material; a plurality of magnetic cores provided outside the heat-generating member and arranged in a rotational axis direction of the heat-generating member; first moving means for moving at least a part of the plurality of magnetic cores from a first position to a second position spaced form the coil; magnetic-flux adjusting means, movable between the magnetic cores and the heat-generating member, for reducing the magnetic flux directed from the magnetic cores toward the heat-generating member; and second moving means for moving, when a first magnetic core in a non-sheet-passing area of the recording material is moved to the second position by the first moving means and a second magnetic core adjacent to the first magnetic core in the non-sheet-passing area is disposed at the first position to heat the image, the magnetic-flux adjusting means to a position corresponding to the second magnetic core.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a) to (c) of FIG. 1 are schematic views each showing an arrangement of a first magnetic-flux adjusting means and a second magnetic-flux adjusting means, in which (a) shows the case where a recording material has a maximum size, (b) shows the case where the recording material has an A4 size, and (c) shows the case where the recording material has an A size.

Figure 3:
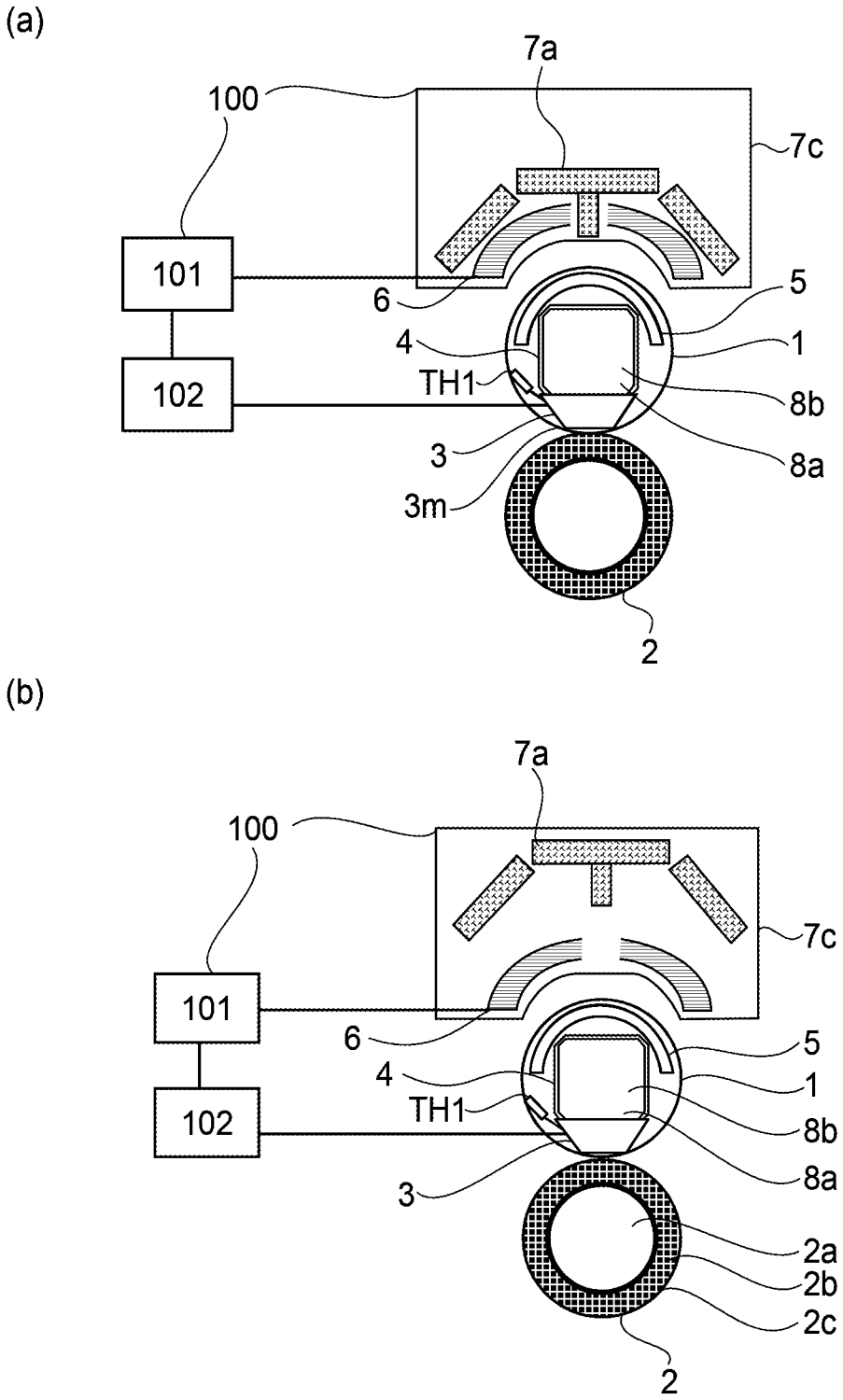

Part (a) of FIG. 3 is an illustration of the image heating apparatus, including a control system, according to the embodiment of the present invention, and (b) of FIG. 3 is an illustration of a status in which a magnetic core is moved.

Figure 4:
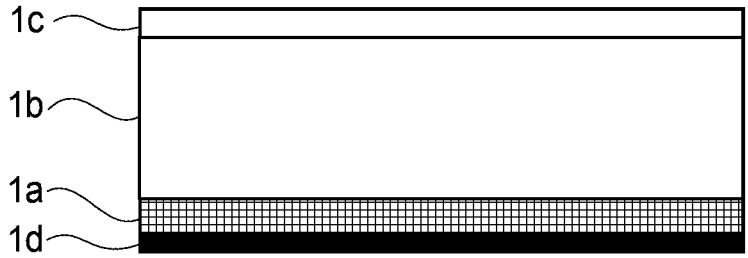

FIG. 4 is a schematic view of a layer structure of a fixing belt in the image heating apparatus according to the embodiment of the present invention.

Figure 5:
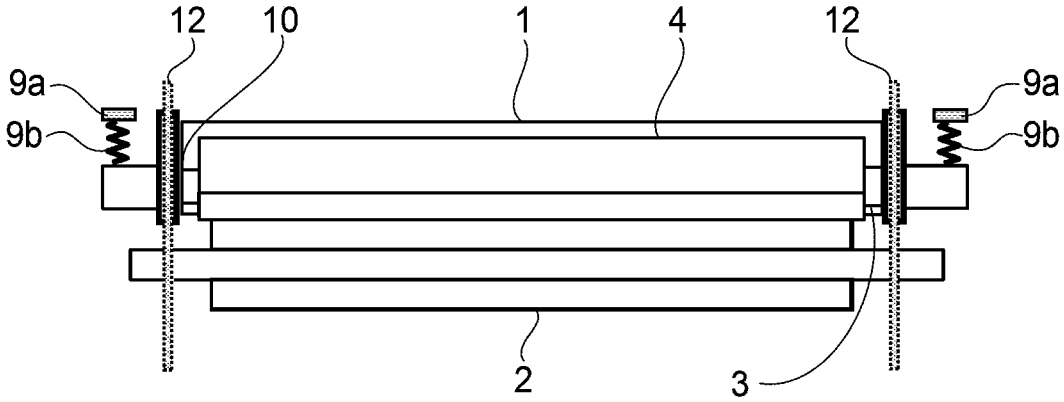

FIG. 5 is a longitudinal sectional view of the image heating apparatus according to the embodiment of the present invention.

Figure 6:
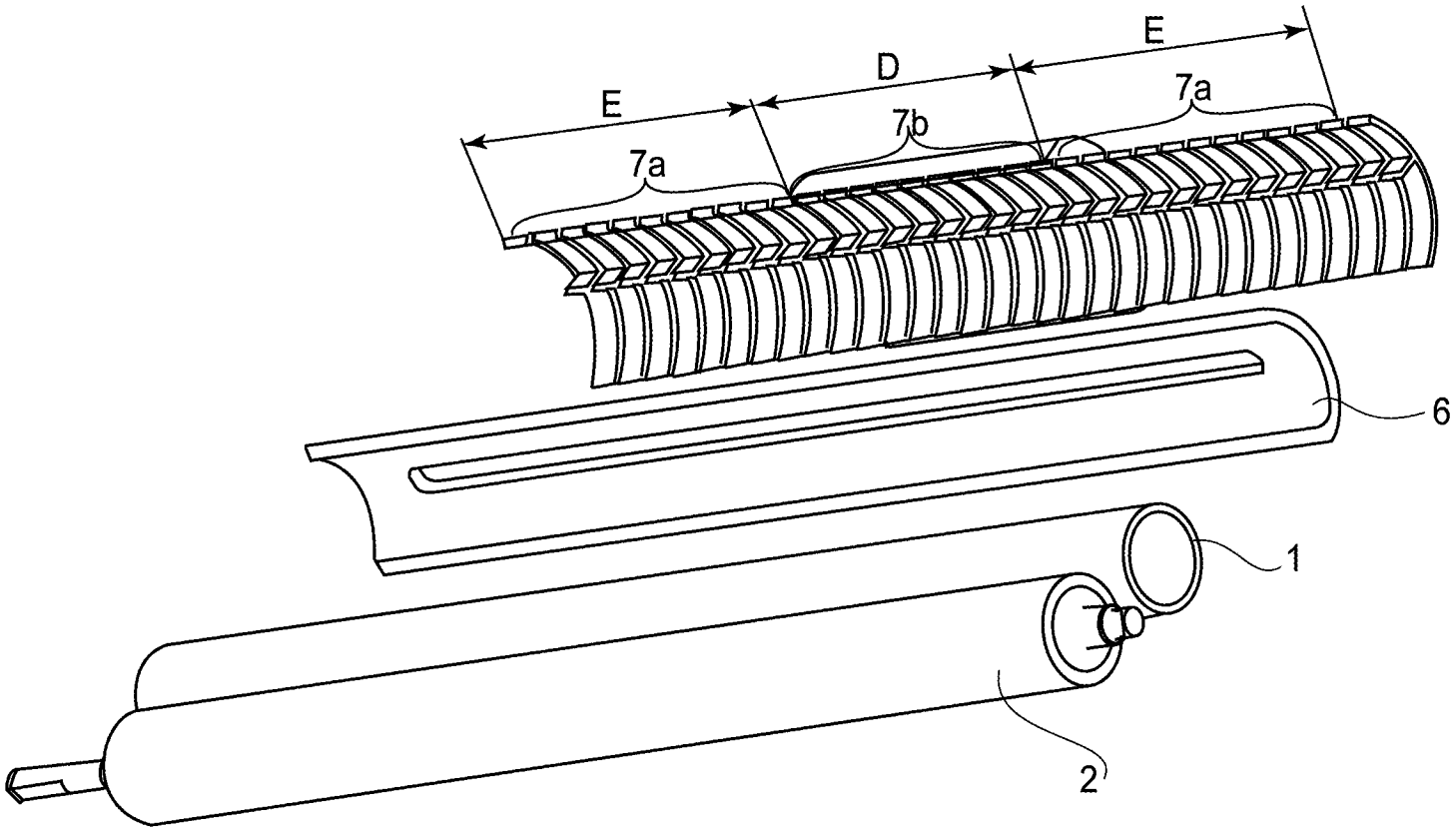

FIG. 6 is a perspective view of the image heating apparatus including the magnetic core as a first magnetic-flux adjusting means and a magnetic flux shielding means as a second magnetic-flux adjusting means.

Figure 7:
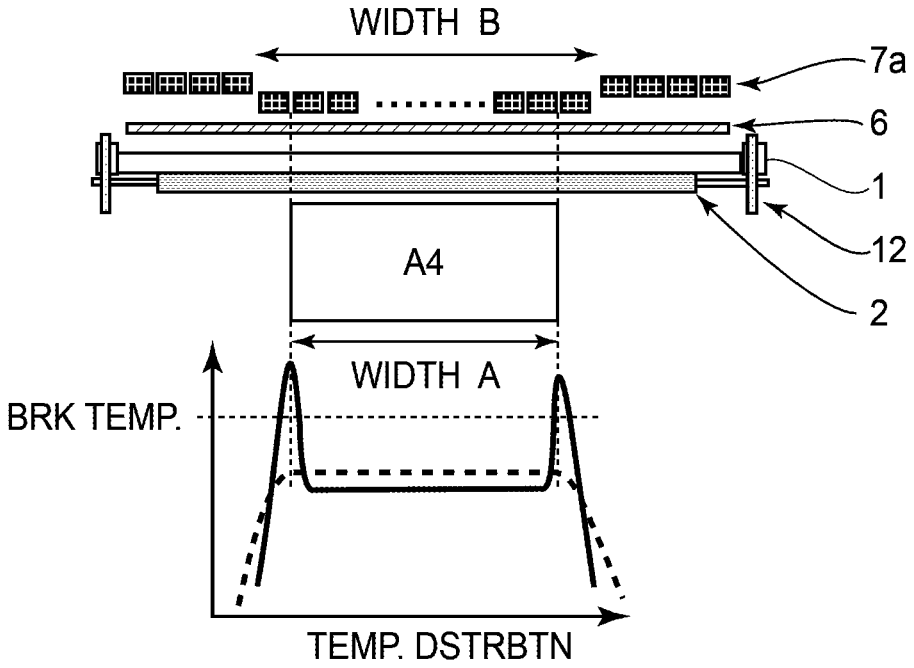

FIG. 7 is an illustration of the case where a width of a recording material is less than a width of the outside magnetic core enhanced in magnetic flux.

Figure 8:
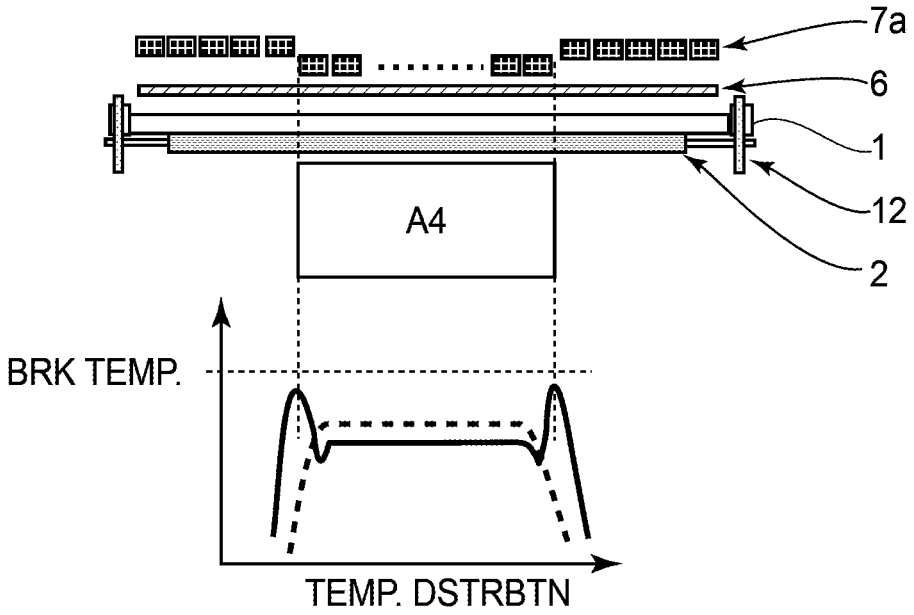

FIG. 8 is an illustration of the case where the width of the recording material is equal to the width of the magnetic core enhanced in magnetic flux.

Figure 9:
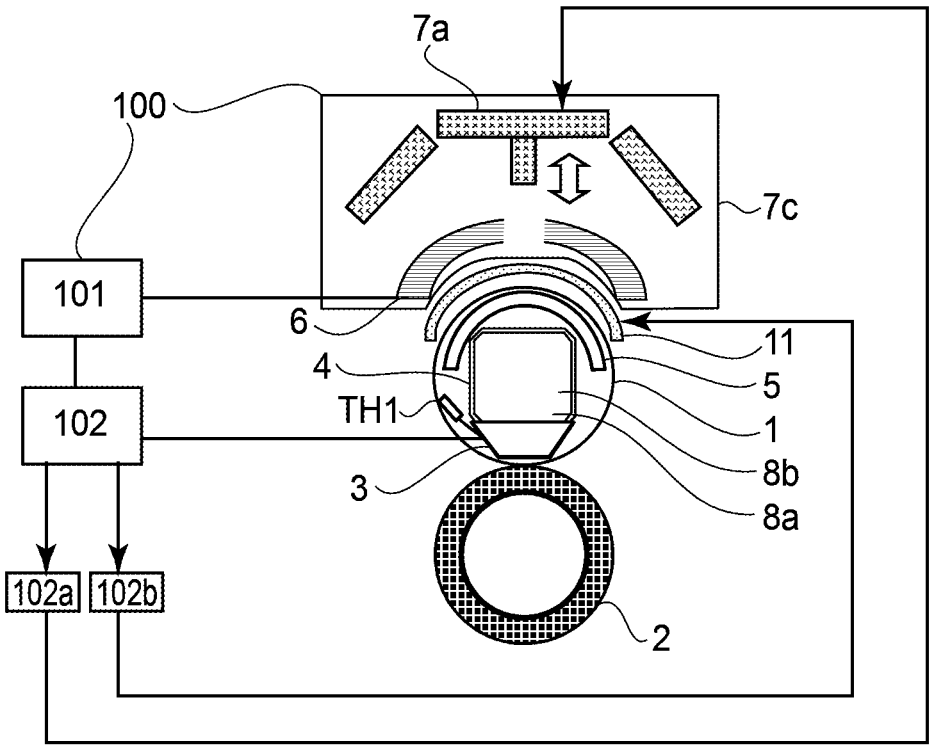

FIG. 9 is an illustration of the image heating apparatus including the control system during insertion of the second magnetic-flux adjusting means.

Figure 10:
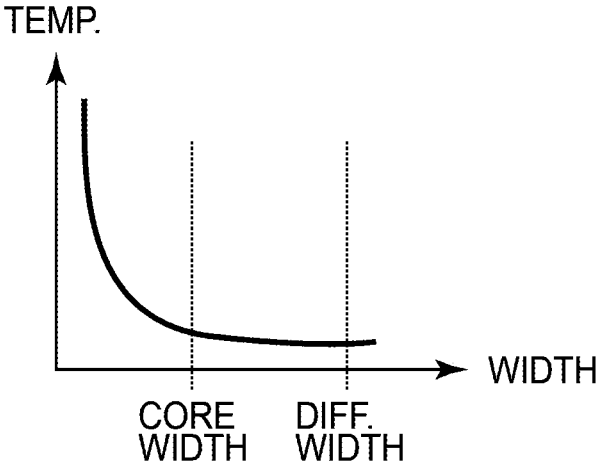

FIG. 10 is a graph showing a relationship between a longitudinal width of the second magnetic-flux adjusting means and temperature rise at recording-material end portions.

Figure 11:
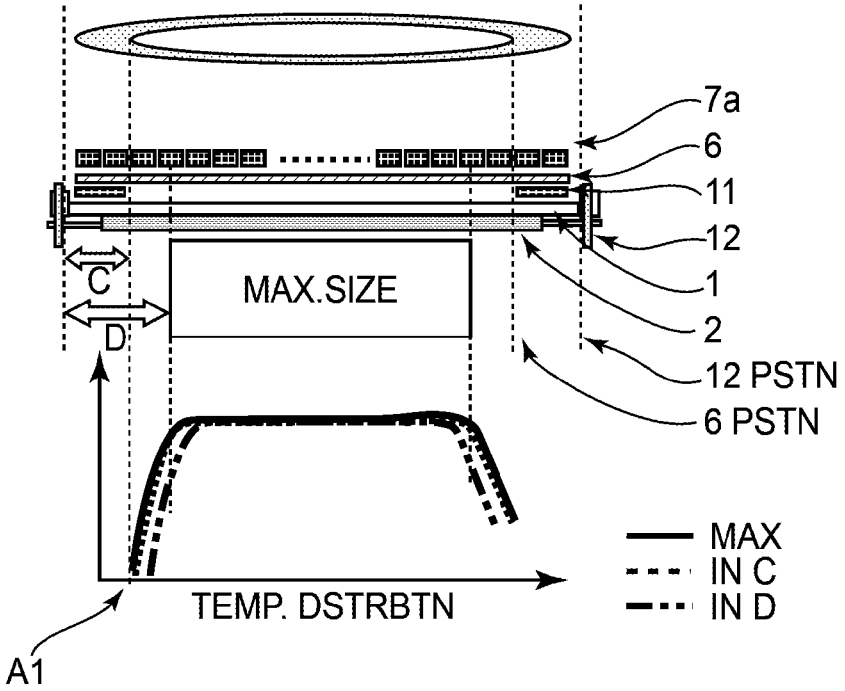

FIG. 11 is a schematic view showing a relationship between the longitudinal width of the second magnetic-flux adjusting means and a longitudinal temperature distribution with respect to maximum-sized paper.

Figure 12:
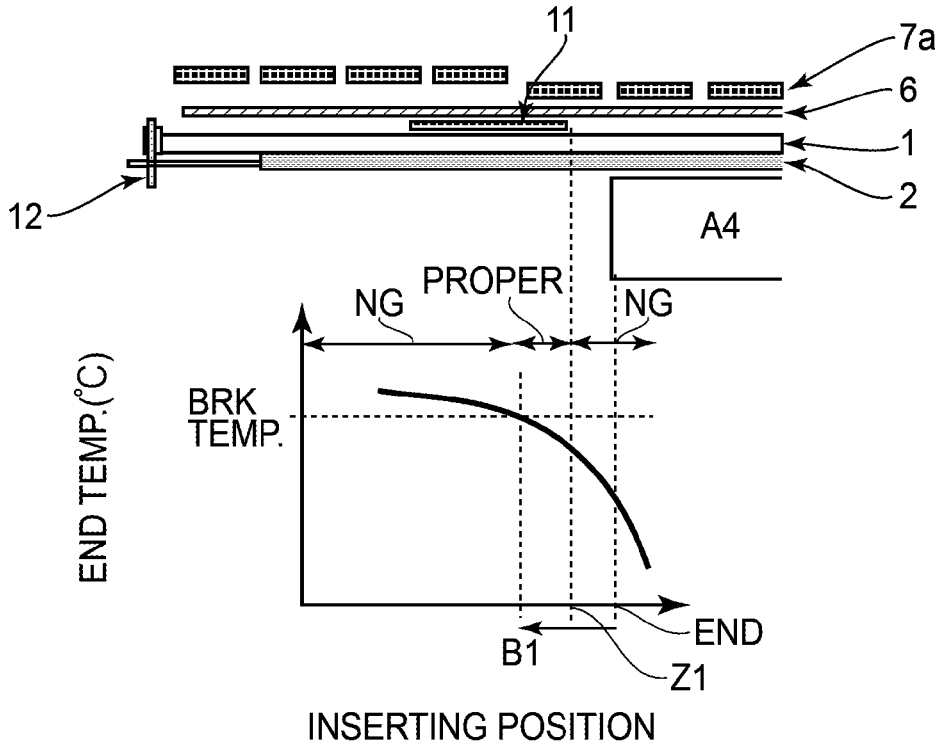

FIG. 12 is a schematic view showing a proper longitudinal insertion position of the second magnetic-flux adjusting means with respect to A4-sized paper.

Figure 13:
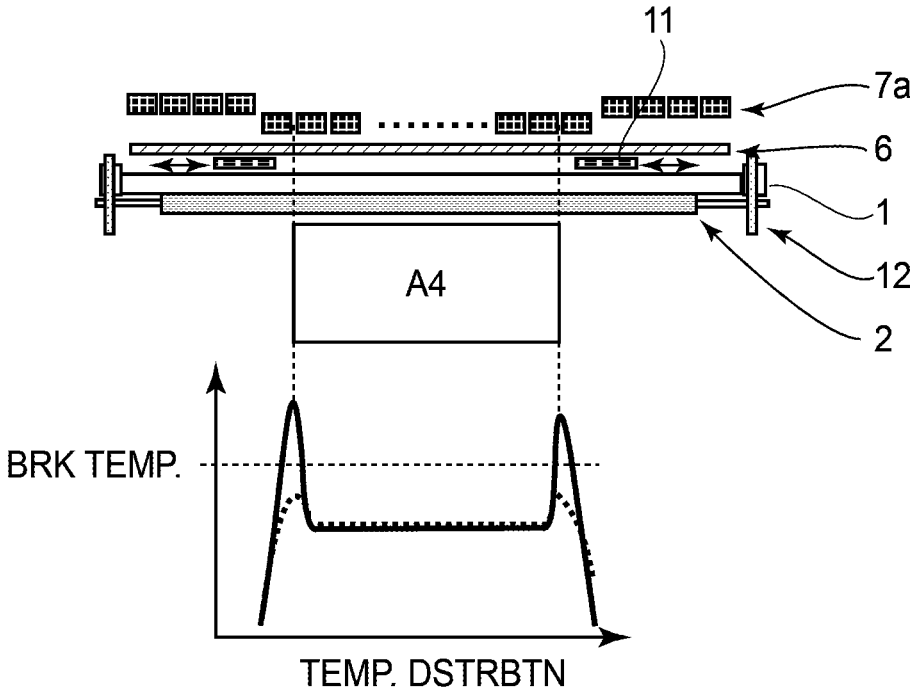

FIG. 13 is a schematic view showing a temperature rise-reducing effect with respect to the A4-sized paper by the second magnetic-flux adjusting means.

Figure 14:
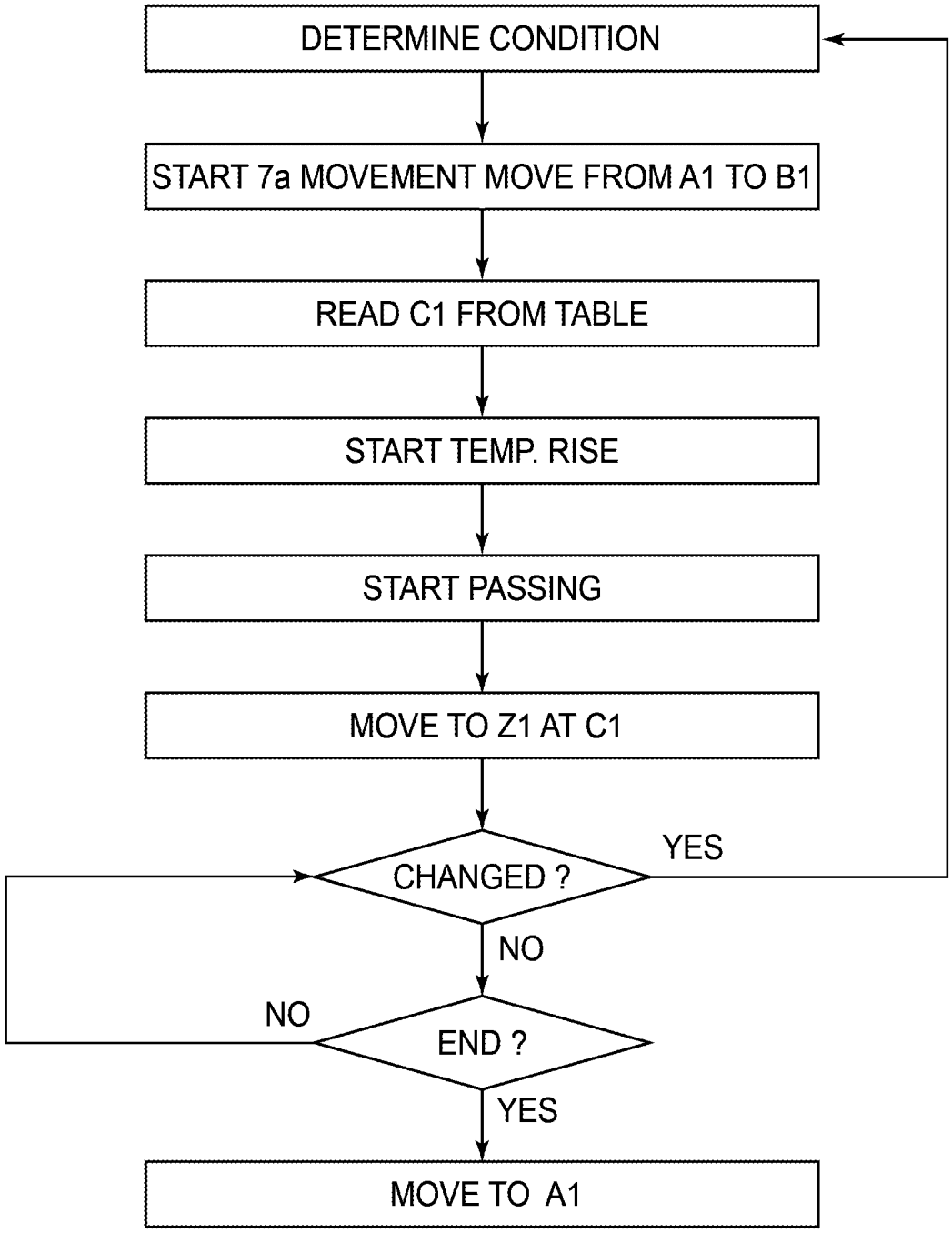

FIG. 14 is a flow chart in First Embodiment.

Figure 15:
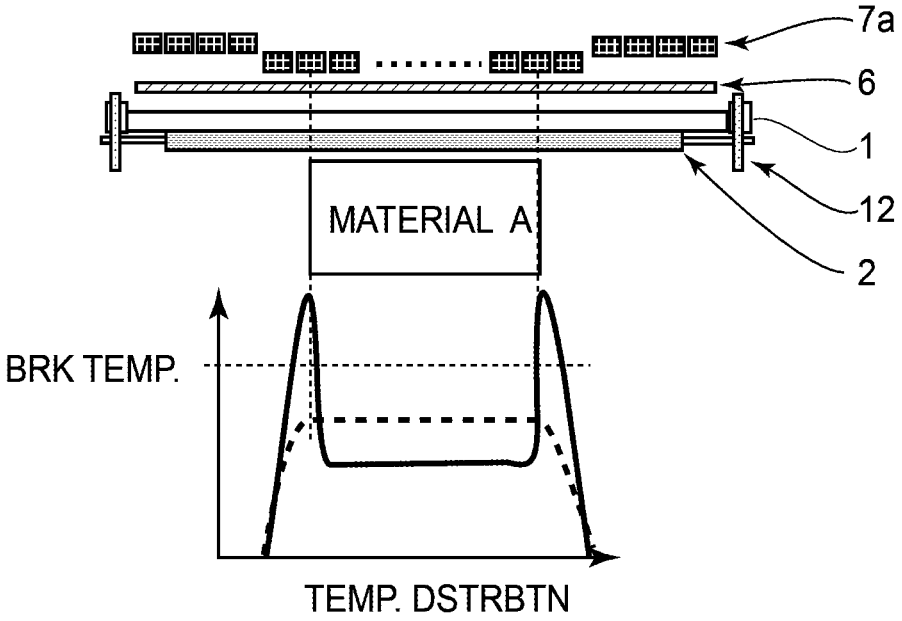

FIG. 15 is a schematic view showing a longitudinal temperature distribution in the case where a magnetic core is moved in Second Embodiment.

Figure 16:
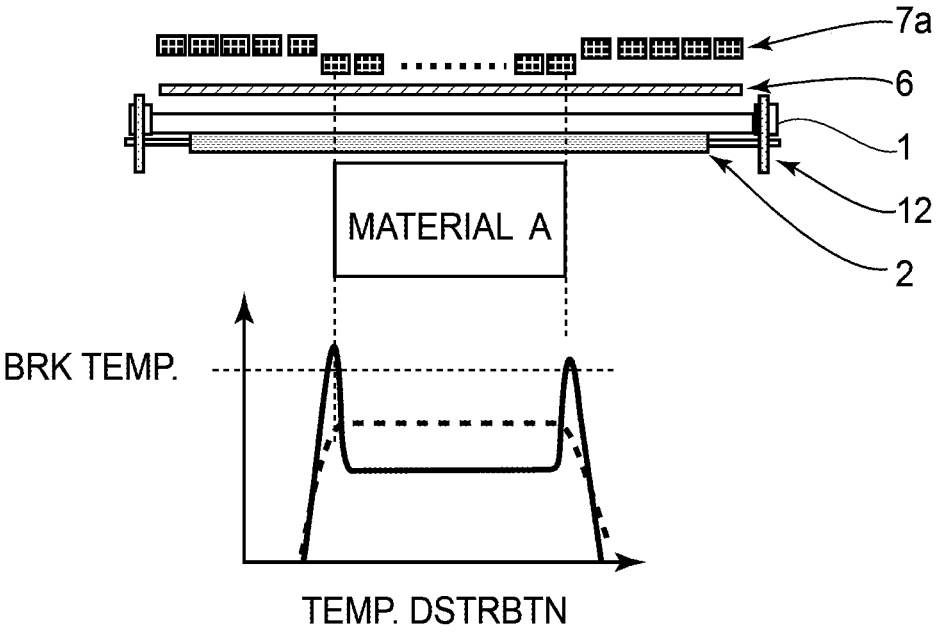

FIG. 16 is a schematic view showing the longitudinal temperature distribution in the case where an end portion-side outside magnetic core is further moved in Second Embodiment.

Figure 17:
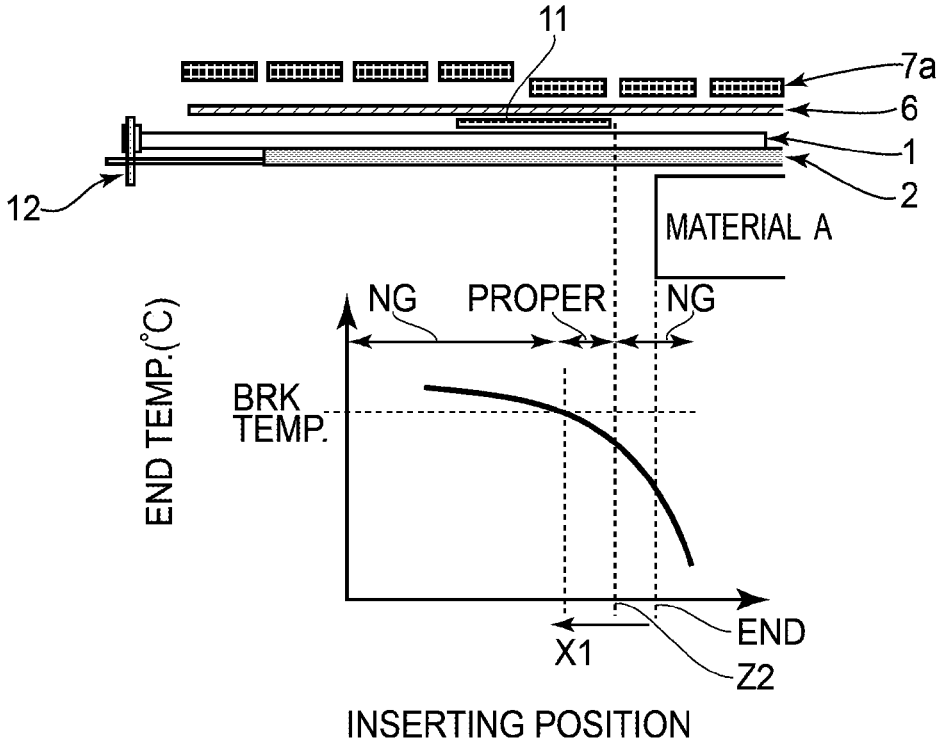

FIG. 17 is a schematic view showing a proper longitudinal insertion position of the second magnetic-flux adjusting means in Second Embodiment.

Figure 18:
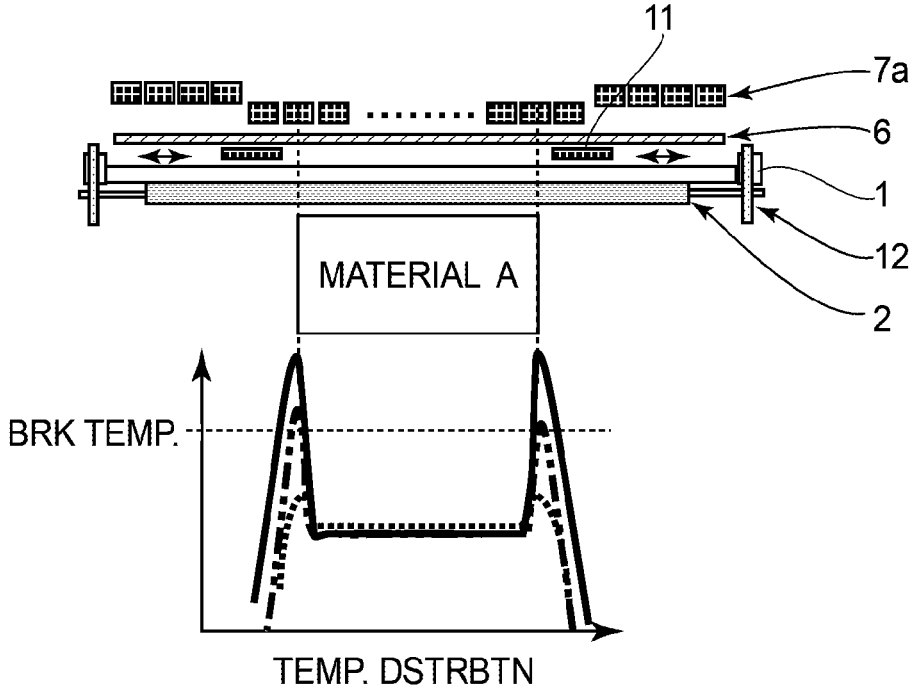

FIG. 18 is a schematic view showing a temperature rise-reducing effect in Second Embodiment.

Figure 19:
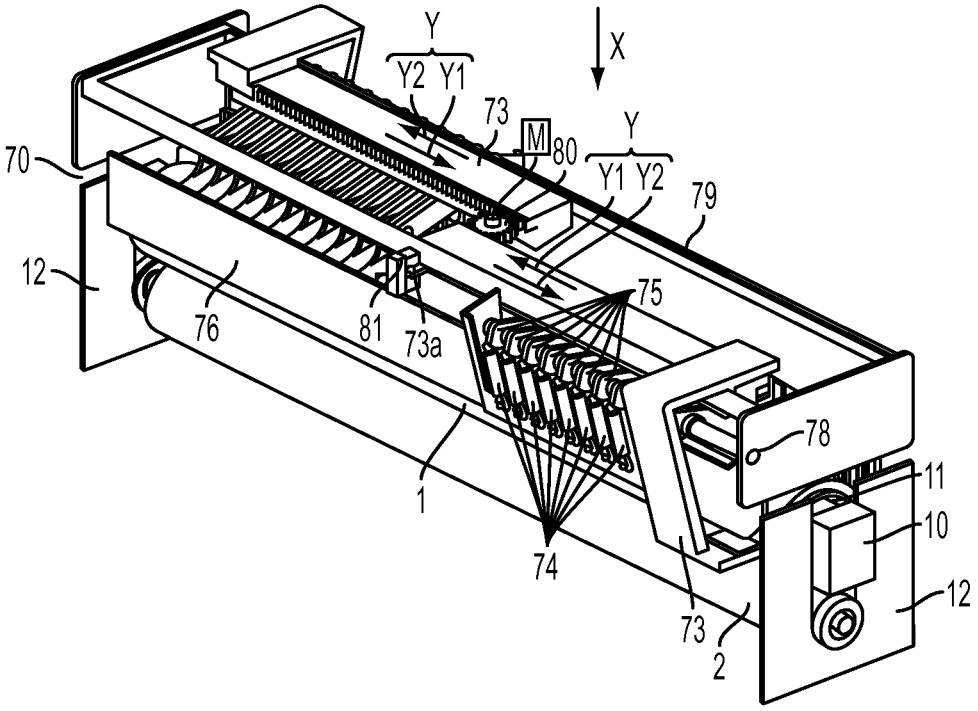

FIG. 19 is a perspective view of an image heating apparatus including a magnetic core as the first magnetic-flux adjusting means and a magnetic flux shielding means as the second magnetic-flux adjusting means in Third Embodiment.

Figure 20:
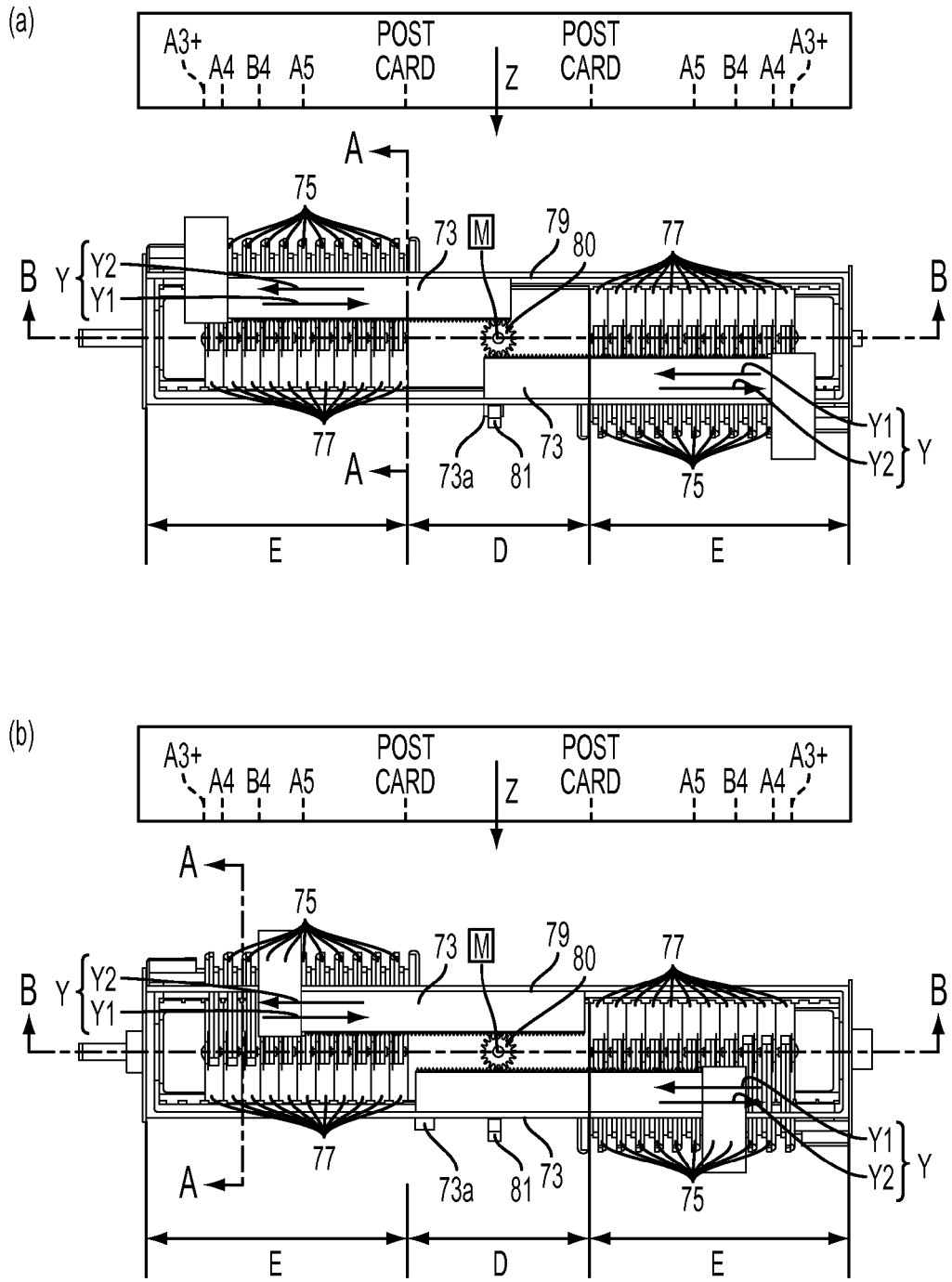

Part (a) of FIG. 20 is a schematic view for illustrating that a preventing member (regulating member) is located at an end portion during large-sized sheet passing in Third Embodiment, and (b) of FIG. 20 is a schematic view for illustrating movement of the preventing member toward a central portion during small-sized sheet passing in Third Embodiment.

Figure 21:
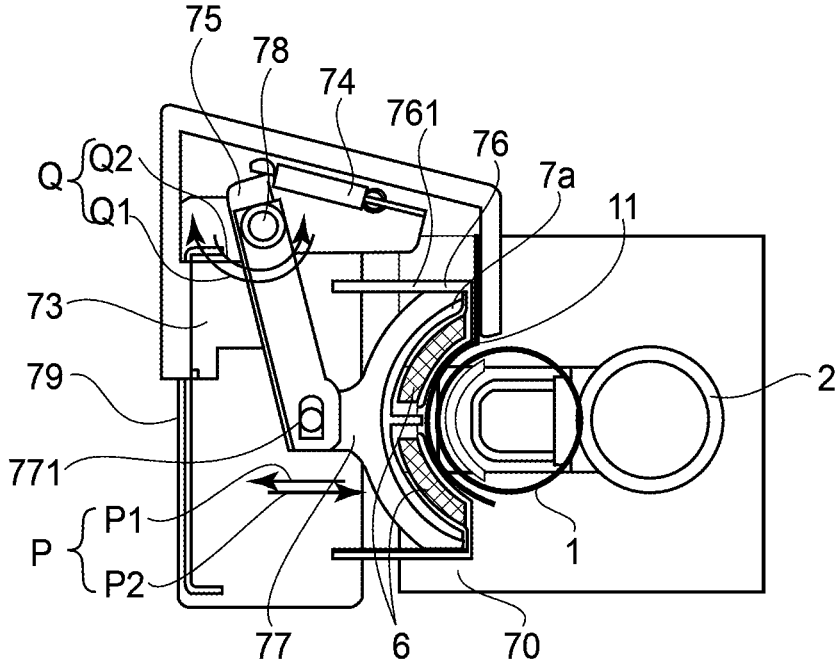
Figure 21:
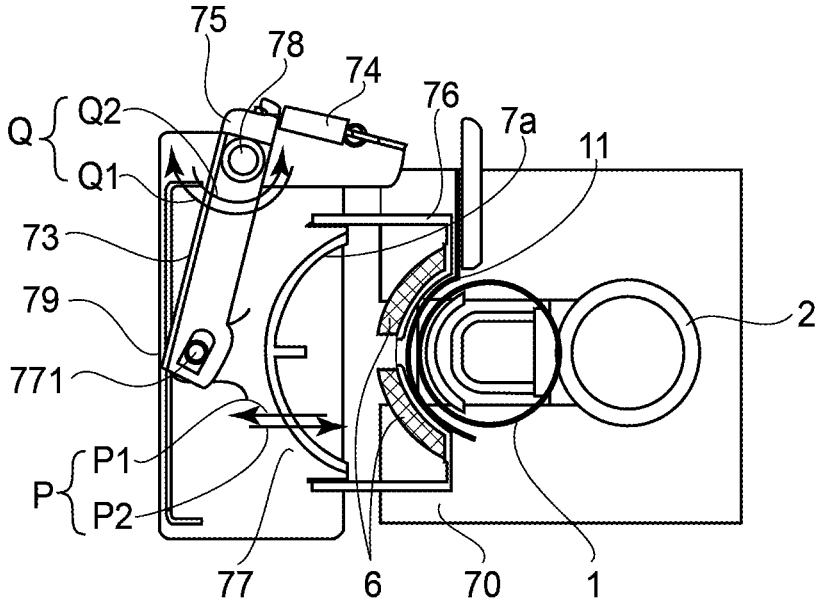

Part (a) of FIG. 21 is an illustration of a state in which the outside magnetic core is close to an exciting coil in Third Embodiment, and (b) of FIG. 21 is an illustration of a state in which the magnetic core is spaced from the exciting coil in Third Embodiment.

Figure 22:
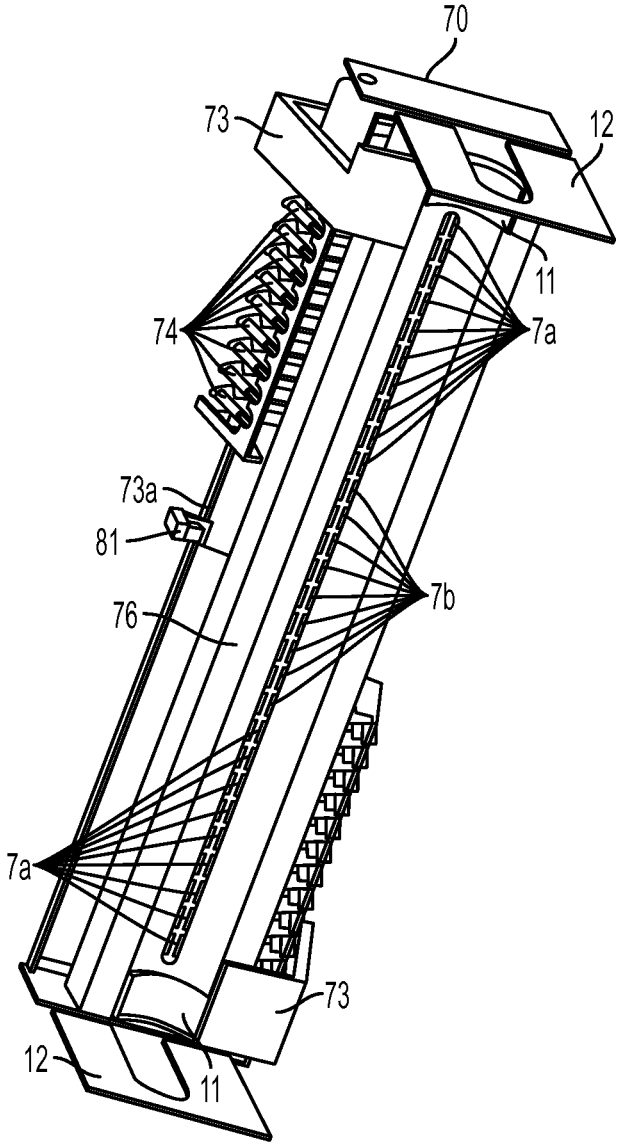

FIG. 22 is a perspective view of an induction heating unit in Third Embodiment.

Figure 23:
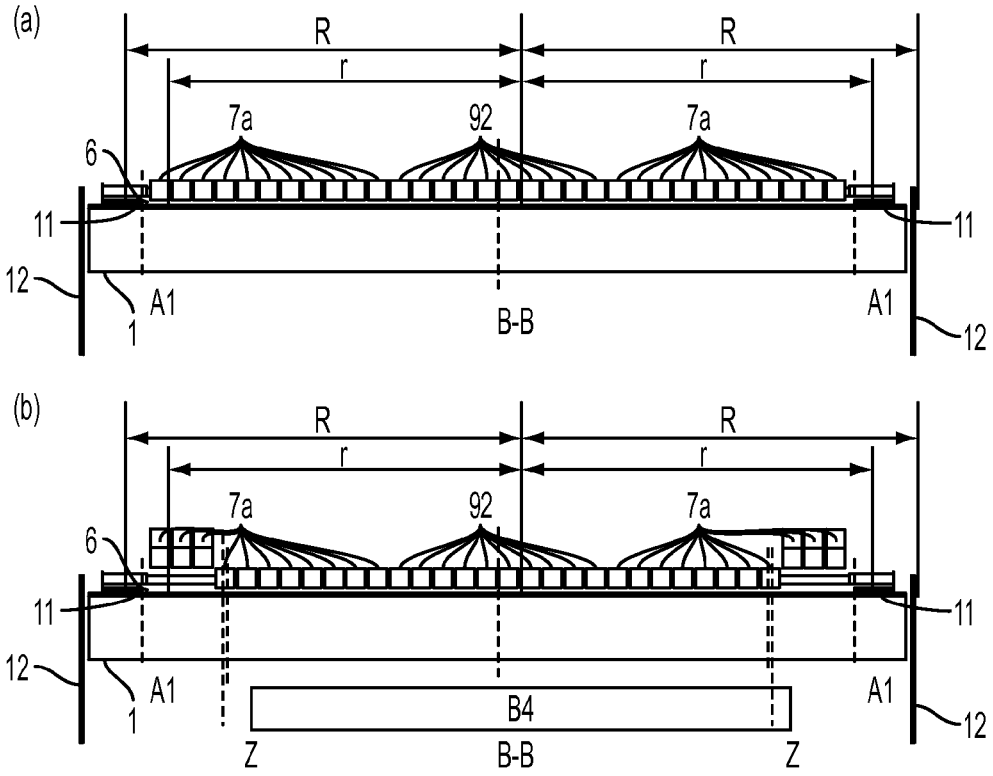

Part (a) of FIG. 23 is a longitudinal arrangement view during maximum-sided sheet passing in Third Embodiment, and (b) of FIG. 23 is a longitudinal arrangement view during B4-sized sheet passing in Third Embodiment.

Figure 24:
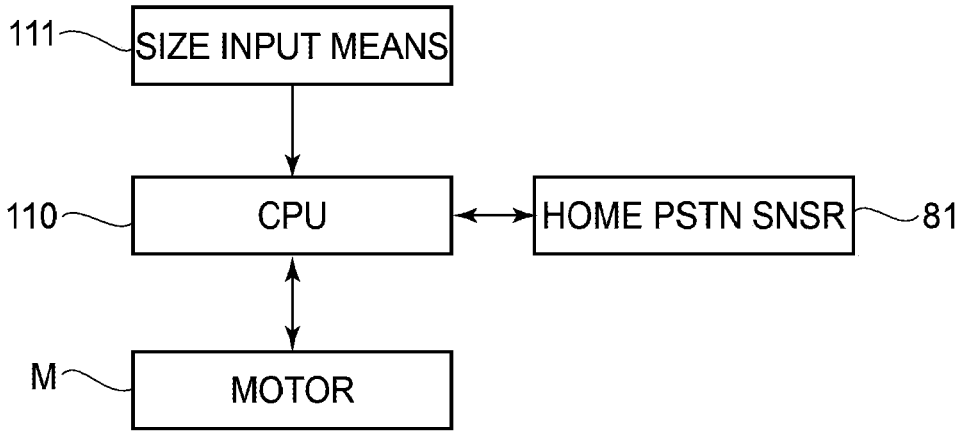

FIG. 24 is a block diagram in Third Embodiment.

Figure 25:
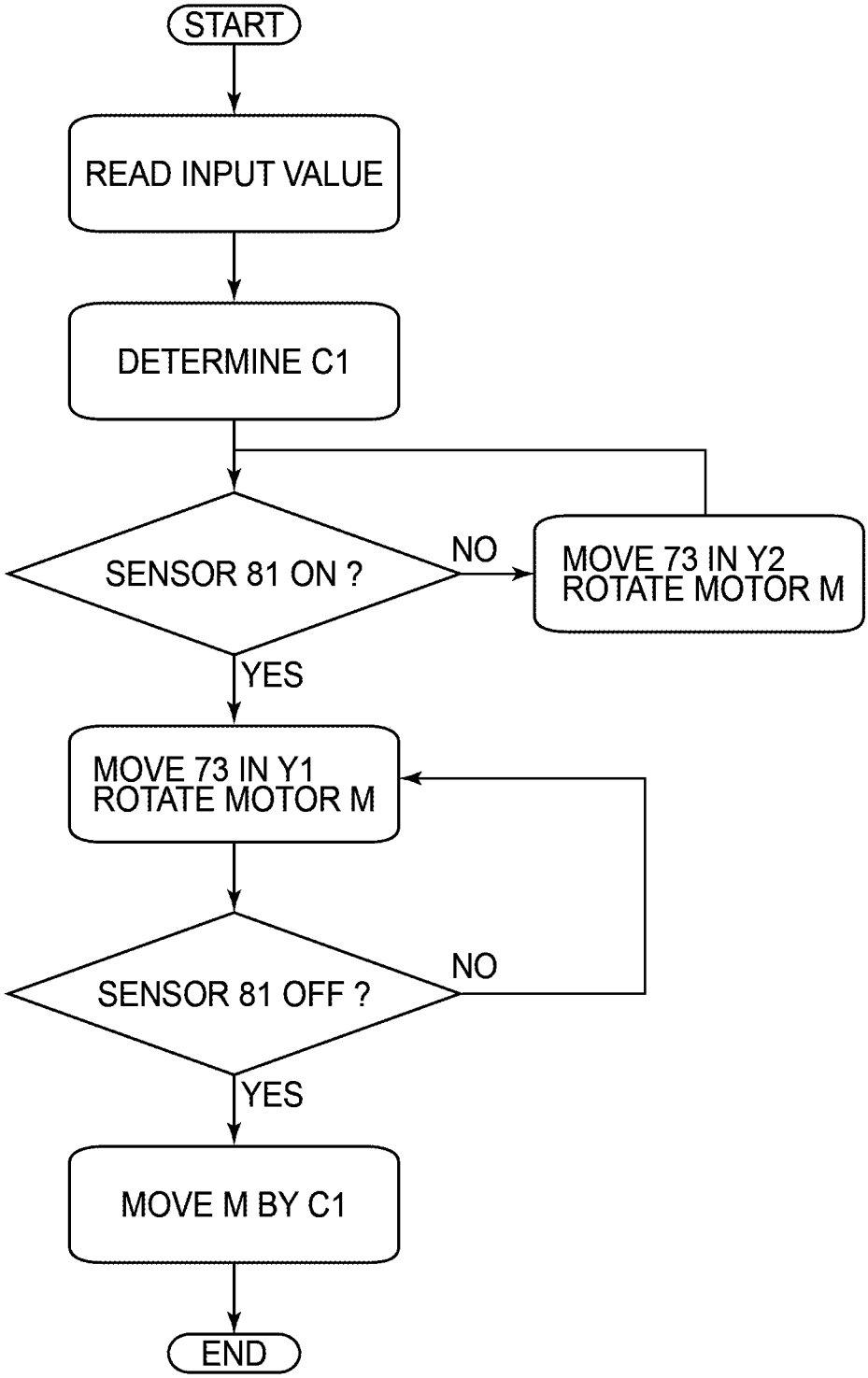

FIG. 25 is a flow chart in Third Embodiment.

Figure 26A:
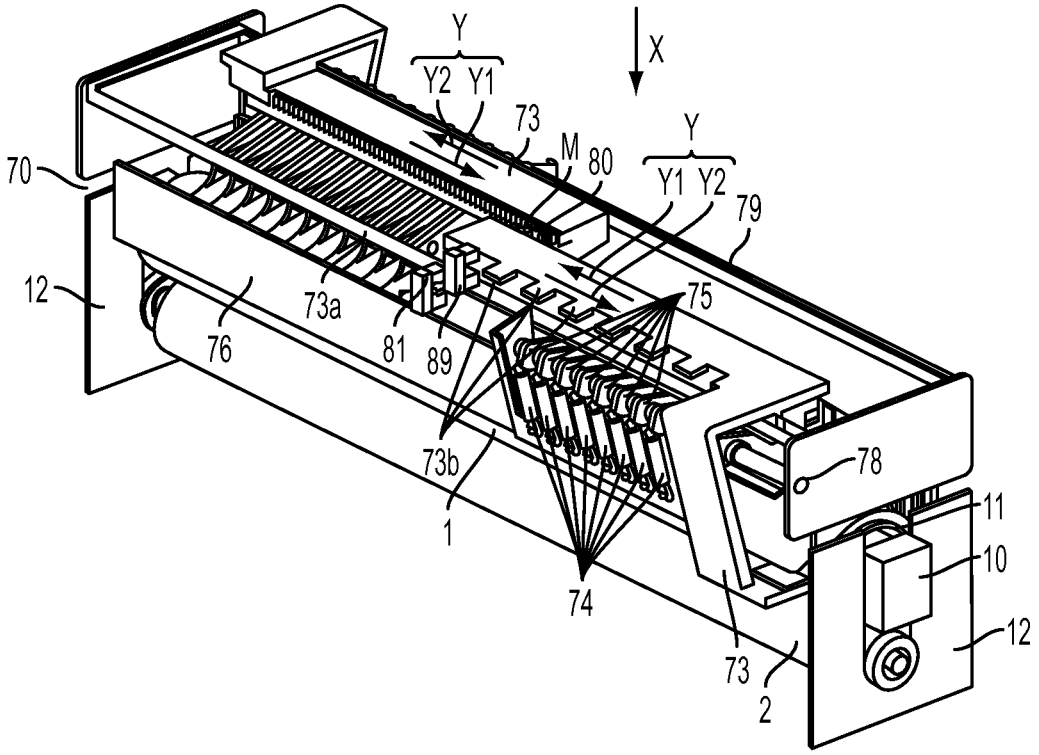
Figure 26B:
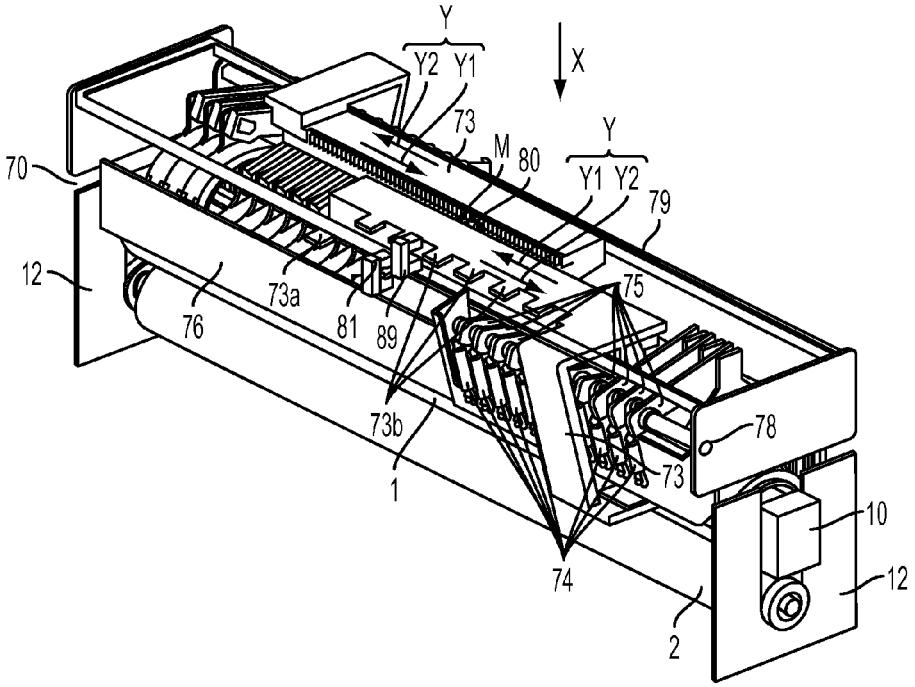

FIG. 26A is a perspective view for illustrating that the preventing member is located at the end portion during the large-sized sheet passing in Third Embodiment, and FIG. 26B is a perspective view for illustrating the movement of the preventing member toward the central portion during the small-sized sheet passing in Third Embodiment.

Figure 27:
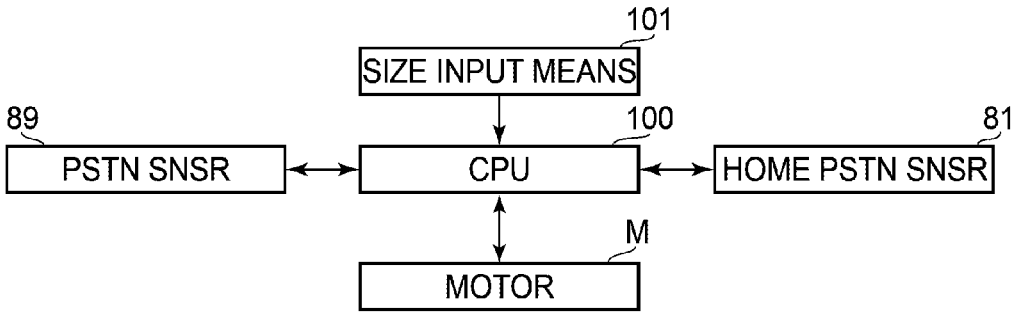

FIG. 27 is a block diagram in Fourth Embodiment.

Figure 28:
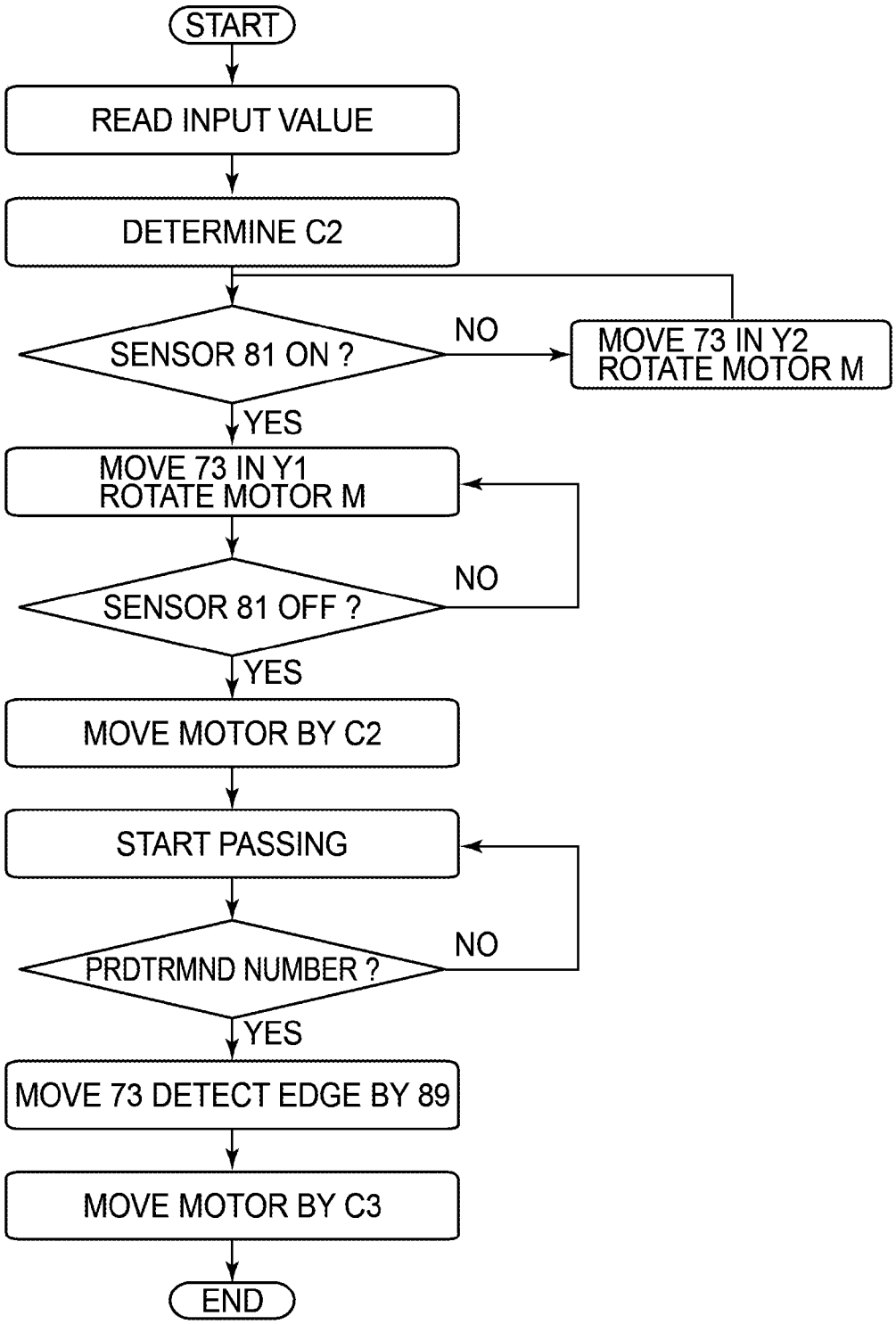

FIG. 28 is a flow chart in Fourth Embodiment.

Figure 29:
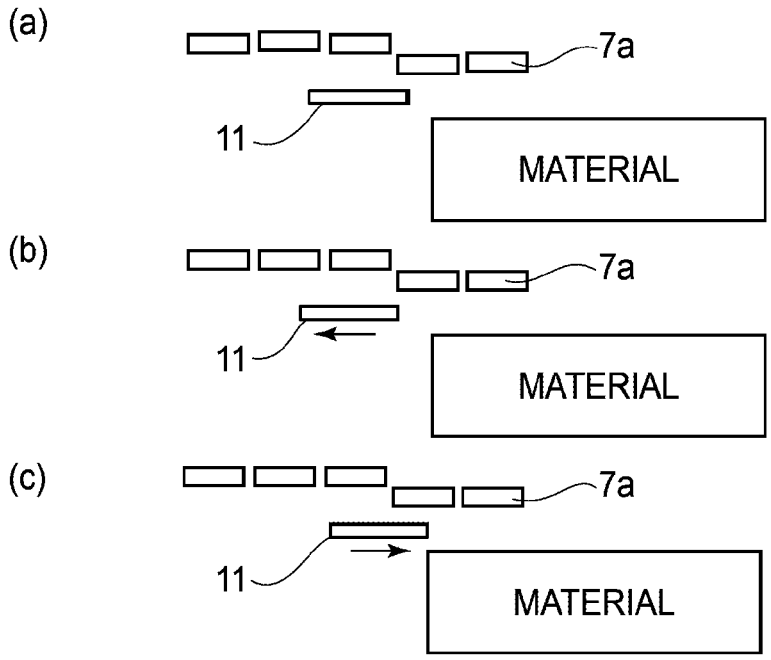

Parts (a), (b) and (c) of FIG. 29 are schematic views each showing a state of a first magnetic-flux adjusting means and a second magnetic-flux adjusting means in a sheet-passing area at one side in Fourth Embodiment, in which (a) shows an initial state of sheet passing, (b) shows a state of reference position detection, and (c) shows a later state of the sheet passing.

Figure 30:
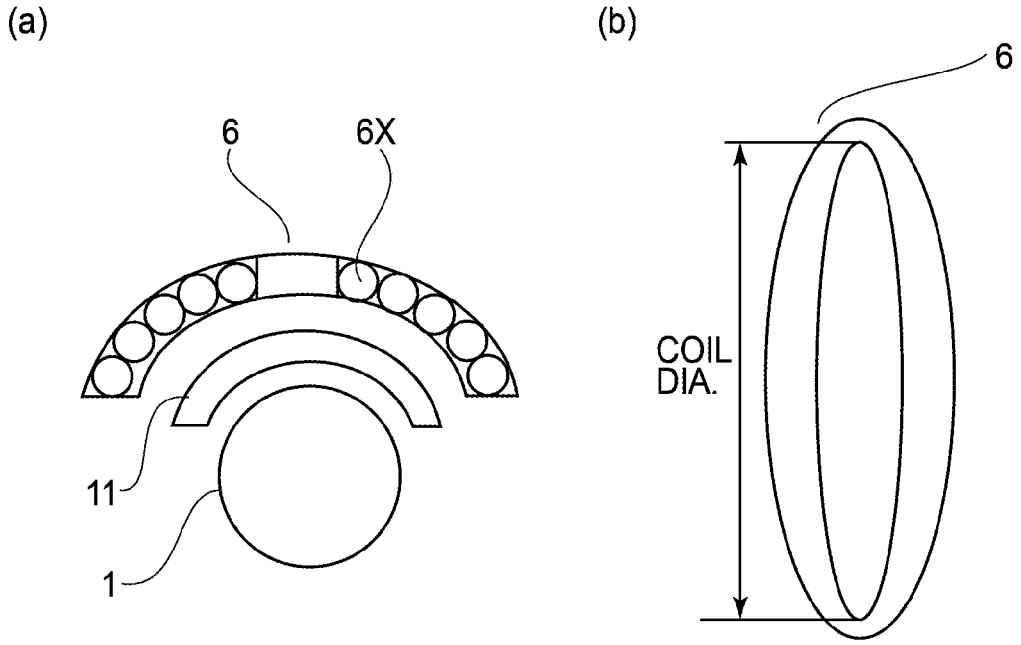

Part (a) of FIG. 30 is a sectional view showing the exciting coil and the second magnetic-flux adjusting means, and (b) of FIG. 30 is a top plan view of the exciting coil.

DESCRIPTION OF THE PREFERRED EMBODIMENTS

Hereinbelow, embodiments of the present invention will be described with reference to the drawings. Incidentally, in all the drawings in the following embodiments, the same or corresponding portions are represented by the same reference numerals or symbols.

First Embodiment (1) Image Forming Apparatus

Figure 1:
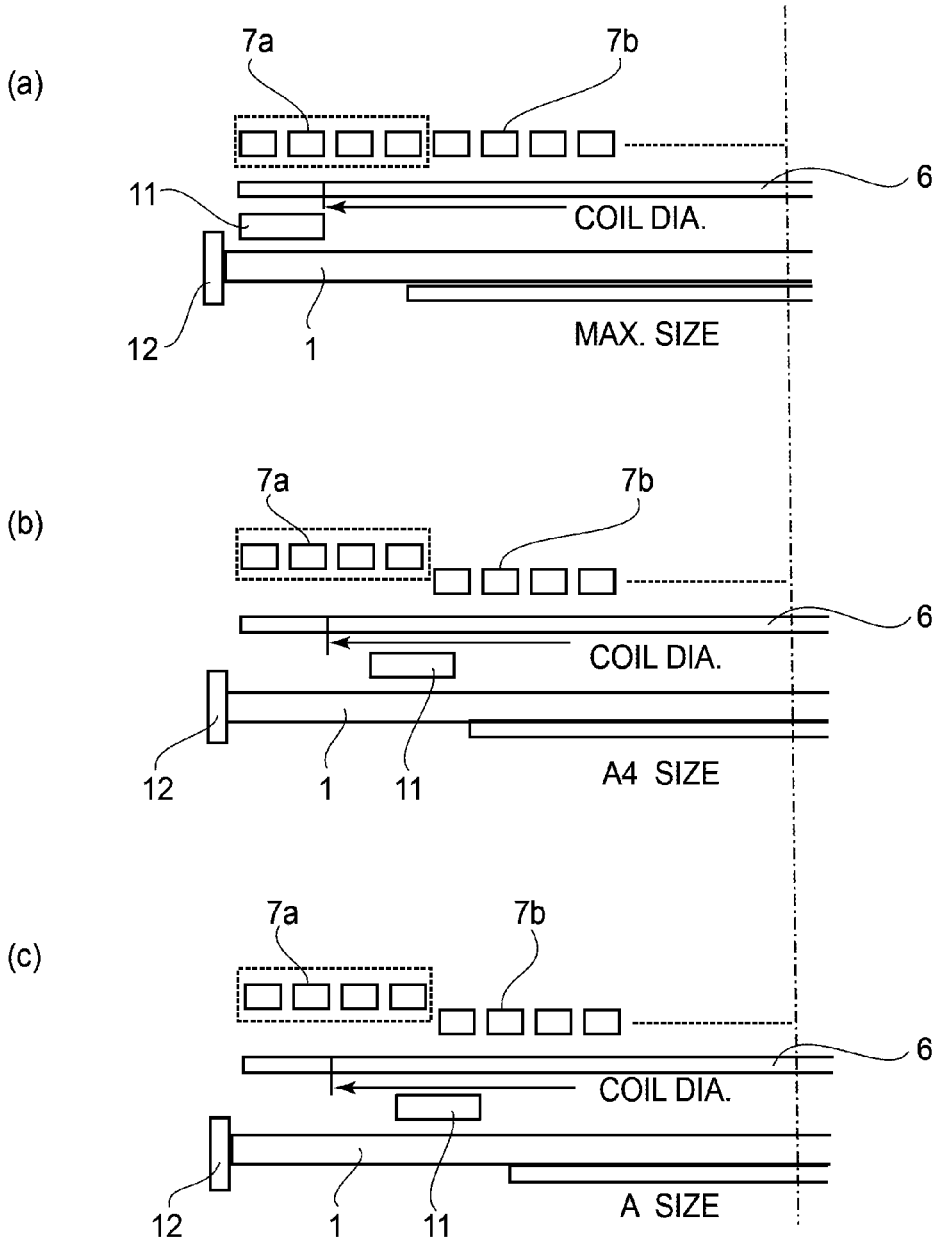
Figure 2:
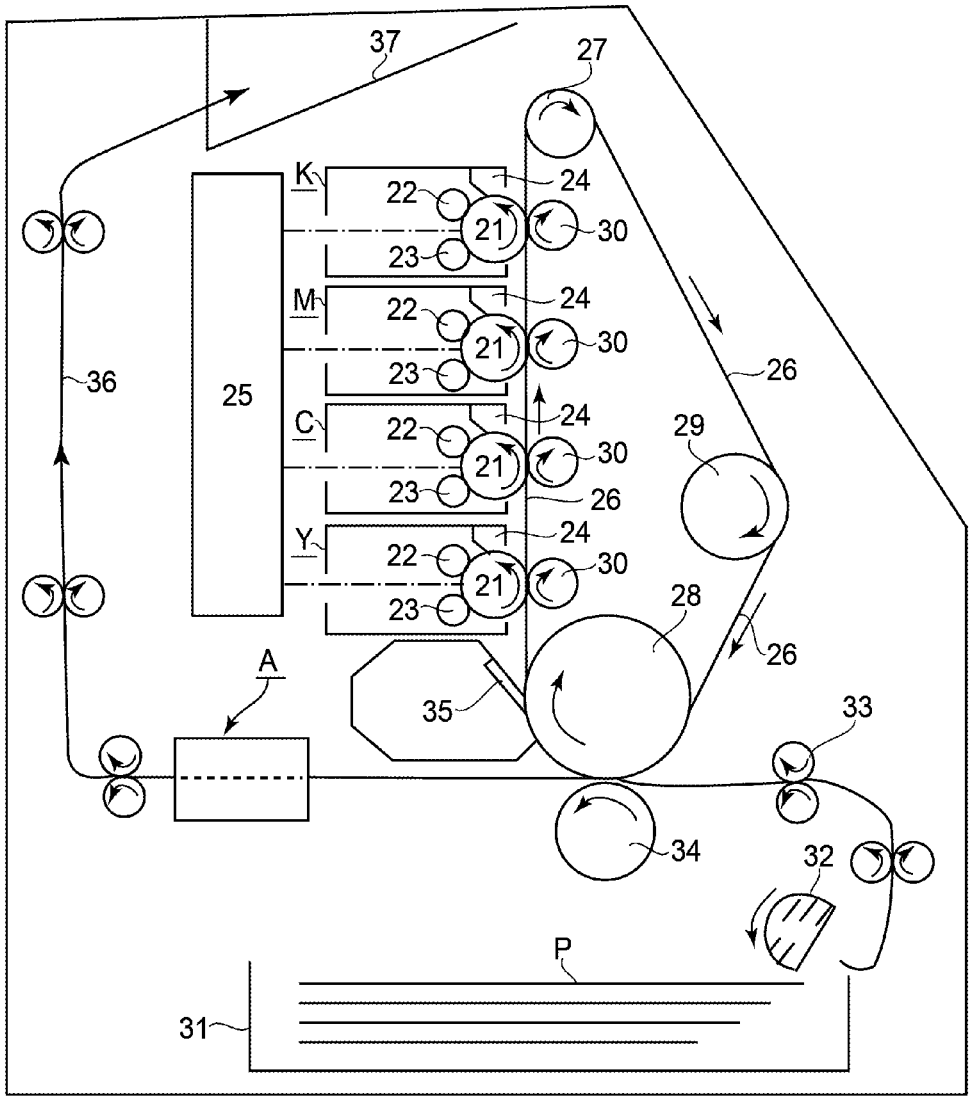
FIG. 2 is a schematic illustration of an image forming apparatus in which an image heating apparatus according to an embodiment of the present invention.

FIG. 2 is a schematic structural view of an embodiment of an image forming apparatus in which an image heating apparatus according to the present invention is mounted as a fixing device. This image forming apparatus is a color image forming apparatus using an electrophotographic method.

Y, C, M and K represent four image forming portions for forming color toner images of yellow, cyan, magenta, and black, respectively, and are arranged in this order from a lower portion to an upper portion. Each of the image forming portions Y, C, M, and K includes a photosensitive drum 21, a charging device 22, a developing device 23, a cleaning device 24, and the like.

In the developing device 23 for the yellow image forming portion Y, yellow toner is accommodated and in the cyan developing device 23 for the image forming portion C, cyan toner is accommodated. In the magenta developing device 23 for the image forming portion M, cyan toner is accommodated and in the black developing device 23 for the image forming portion K, black toner is accommodated.

An optical system 25 for forming an electrostatic latent image by subjecting each of the drums 21 to exposure to light is provided correspondingly to the above-described four color image forming portions Y, C, M and K. As the optical system, 25, a laser scanning exposure optical system is used.

At each of the image forming portions, Y, C, M and K, the drum 21 electrically charged uniformly by the charging device 22 is subjected to scanning exposure on the basis of image data by the optical system 25, so that an electrostatic latent image corresponding to a scanning exposure image pattern is formed on the drum surface.

The resultant electrostatic latent images are developed into the toner images by the developing devices 23. That is, a yellow toner image is formed on the drum 21 for the yellow image forming portion Y and a cyan toner image is formed on the drum 21 for the cyan image forming portion C. Further, a magenta toner image is formed on the drum 21 for the magenta image forming portion M and a black toner image is formed on the drum 21 for the image forming portion K.

The above-described color toner images formed on the drums 21 for the respective image forming portions Y, C, M and K are successively primary-transferred onto an intermediary transfer member 26, rotated in synchronism with and at the substantially same speed as rotation of the respective drums 21, in a predetermined alignment state in a superposed manner. As a result, unfixed full-color toner images are synthetically formed on the intermediary transfer member 26. In this embodiment, as the intermediary transfer member 26, an endless intermediary transfer belt is used and is stretched around three rollers consisting of a driving roller 27, a secondary transfer opposite roller 28, and a tension roller 29, thus being driven by the driving roller 27.

As a primary transfer means for transferring the toner image from the drum 21 for each of the image forming portions Y, C, M and K onto the intermediary transfer belt 26, a primary transfer roller 30 is used. To the primary transfer roller 30, a primary transfer bias of a polarity opposite to that of the toner is applied from an unshown bias power source. As a result, the toner image is primary-transferred from the drum 21 for each of the image forming portions Y, C, M and K onto the intermediary transfer belt 26. After the primary-transfer from the drum 21 onto the intermediary transfer belt 26 at each of the image forming portions Y, C, M and K, toner remaining on the photosensitive drum 21 as transfer residual toner is removed by the cleaning device 24.

The above-described steps are performed with respect to the respective colors of yellow, cyan, magenta, and black in synchronism with the rotation of the intermediary transfer belt 26 to successively form the primary-transfer toner images for the respective colors on the intermediary transfer belt 26 in the superposition manner. Incidentally, during image formation for only a single color (in a single color mode), the above-described steps are performed for only an objective color.

A recording material P in a recording material cassette 31 is separated and fed by a feeding roller 32 one by one. The fed recording material P is conveyed, with predetermined timing by registration rollers 33, to a transfer nip (portion), which is a press-contact portion between a secondary transfer roller 34 and an intermediary transfer belt 26 portion extended around the secondary transfer opposite roller 28.

The primary-transferred synthetic toner images formed on the intermediary transfer belt 26 are simultaneously transferred onto the recording material P by a bias, of a polarity opposite to that of the toner, applied from an unshown bias power source to the secondary transfer roller 34. After the secondary transfer, secondary transfer residual toner remaining on the intermediary transfer belt 26 is removed by an intermediary transfer belt cleaning device 35.

The toner images secondary-transferred onto the recording material P are fixed through fusing and mixing on the recording material P by a fixing device A as the image heating apparatus, so that the recording material P is sent, as a full-color print, to a sheet discharge tray 37 through a sheet discharge path 36.

(Fixing Device)

In the following description, with respect to the fixing device or members constituting the fixing device, a longitudinal direction refers to a direction parallel to a direction (a rotational axis direction of a heating rotatable member) perpendicular to a recording-material conveyance direction in a plane of a recording-material conveyance path. Further, a widthwise direction refers to a direction parallel to the recording-material conveyance direction. With respect to the fixing device, a front surface refers to a surface as seen from a recording material entrance side with respect to the recording-material conveyance direction, and a rear surface is a surface (a recording material exit side) opposite from the front surface. The left (side) and the right (side) refer to left (side) and right (side) as seen from the front surface side. An upstream side and a downstream side refer to an upstream side and a downstream side with respect to the recording-material conveyance direction.

Parts (a) and (b) of FIG. 3 are enlarged cross-sectional side views of a principal part of the fixing device, including a control system, as the image heating apparatus in this embodiment. An endless belt 1 has a metal layer. A pressing roller 2 as a pressing member is provided in contact with an outer peripheral surface of the fixing belt 1. A pressure-applying member 3 forms a fixing nip N by applying pressure between the fixing belt 1 and the pressing roller 2 and is held by a metal stay 4.

Further, at a side where the stay 4 opposes an exciting coil 6, a magnetic shielding core 5 as a magnetic shielding member for preventing a temperature rise by induction heating is provided. Left and right fixing flanges 10 as a preventing member (regulating member) for preventing (regulating) longitudinal movement of and circumferential shape of the fixing belt 1 are provided as shown in FIG. 5. A pressing-down force is applied to the stay 4 by compressedly providing a stay urging spring 9*b* between a device chassis-side spring receiving member 9*a* and each of end portions of the stay 4 inserted and provided into the fixing flanges 10. As a result, a lower surface of each fixing flange 10 and an upper surface of the pressing roller 2 form the fixing nip N with a predetermined width by causing the fixing belt 1 to press-contact the pressing roller 2.

Part (a) of FIG. 3 shows an induction heating apparatus (device) 100 as a heating source (induction heating means) for induction-heating the fixing belt 1. This induction heating apparatus 100 includes, as will be described later, an exciting coil 6 and an outside magnetic core 7*a* which is coated on the exciting coil 6 so that a magnetic field generated by the exciting coil 6 is not substantially leaked from the metal layer (electroconductive layer) of the fixing belt 1. Further, the induction heating apparatus 100 is constituted by these members 6 and 7*a* and a mold member 7*c* which supports these members 6 and 7*a* by an electrically insulating resin material.

This induction heating apparatus 100 is provided opposed to the fixing belt 1 with a predetermined gap (spacing) at an upper surface side of the outer peripheral surface of the fixing belt 1. As shown in (b) of FIG. 3, by increasing the gap between the exciting coil 6 and the outside magnetic core 7*a* at a non-sheet-passing portion, a density of magnetic flux passing through the fixing belt 1 is decreases, so that a heat-generation amount (quantity) of the fixing belt 1 is lowered. That is, the outside magnetic core 7*a* located at the longitudinal end side is moved, to a second position which is a retracted position (position of (b) of FIG. 3) in which it is spaced from the fixing belt 1 which is a rotatable heat-generating member, from a first position which is a heating position (position of (a) of FIG. 3) in which it is brought near to the heat-generating member than the retracted position.

As a result, a longitudinal density distribution of the magnetic flux acting on the fixing belt 1 is changed, so that it is possible to lower the heat-generation amount in a non-sheet-passing area when the recording material with a width smaller than a width of a maximum-sized recording material passable in a rotational axis direction is subjected to sheet passing. A moving means for moving the outside magnetic core 7*a* includes a controller and a moving mechanism and functions as a first moving means.

In a rotation state of the fixing belt 1, to the exciting coil 6 of the induction heating apparatus 100, a high-frequency current of 20-50 kHz is applied from a power source device 101 (including an exciting circuit), so that the metal layer (electroconductive layer) of the fixing belt 1 is induction-heated by the magnetic field generated by the exciting coil 6.

A temperature sensor (temperature detecting element) TH1 such as a thermistor is provided in contact with the fixing belt 1 at a position of a widthwise inner central-surface portion of the fixing belt 1. This temperature sensor TH1 detects the temperature of a fixing belt portion in a sheet-passing area and its detection temperature information is fed back to a control circuit portion 102. The control circuit portion 102 controls electric power inputted from the power source device 101 into the exciting coil 6 so that a detection temperature inputted from the temperature sensor TH1 is kept at a predetermined target temperature (fixing temperature). That is, in the case where the detection temperature of the fixing belt 1 is increased to the predetermined temperature, energization to the exciting coil 6 is interrupted.

In temperature, temperature control is effected by controlling the electric power inputted into the exciting coil 6 by changing the frequency of the high-frequency current on the basis of a detected value of the temperature sensor TH1 so that the temperature of the fixing belt 1 is constant at 180° C., which is the target temperature of the fixing belt 1.

The temperature TH1 described above is mounted on the pressure applying member 3 via an elastic supporting member and is constituted so that a good contact state is maintained, even when a positional fluctuation such as waving of a contact surface of the fixing belt 1 is caused, by following the positional fluctuation.

The fixing belt 1 is rotationally driven by the pressing roller 2 through a motor (driving means) M1 controlled by the control circuit portion 102 at least during execution of the image formation. As a result, the fixing belt 1 is rotationally driven at a peripheral speed substantially equal to a conveyance speed of the recording material P carrying an unfixed toner image T conveyed from the image forming portion side of FIG. 2. In this embodiment, a surface rotational speed of the fixing belt 1 is 300 mm/sec and it is possible to fix the full-color image on 80 sheets per minute for A4 size and on 58 sheets per minute for A4R size.

Further, electric power is supplied from the power source device 101, controlled by the control circuit portion 102, to the exciting coil 6 of the induction heating apparatus 100, so that the fixing belt 1 is raised in temperature to a predetermined fixing temperature and is placed in a temperature-controlled state. In that state, between the fixing belt 1 and the pressing roller 2 in the fixing nip N, the recording material P carrying thereon the unfixed toner image T is nip-conveyed with its toner image carrying surface toward the fixing belt 1. Then, the recording material P is intimately contacted to the outer peripheral surface of the fixing belt 1 in the fixing nip N and is nip-conveyed together with the fixing belt 1 through the fixing nip N.

As a result, the heat of the fixing belt 1 is principally provided to the recording material P and the pressure of the fixing nip N is applied to the recording material P, so that the unfixed toner image T is heat-fixed on the surface of the recording material P. The recording material P passing through the fixing nip N is self-separated from the outer peripheral surface of the fixing belt 1 by deformation of the surface of the fixing belt 1 at an exit portion of the fixing nip N, thus being conveyed to the outside of the fixing device.

(Fixing Belt)

FIG. 4 is a schematic view showing a layer structure of the fixing belt 1. The fixing belt 1 has an inner diameter of 30 mm and includes a base layer (metal layer) 1*a* of nickel, which is manufactured through electroforming. The base layer 1*a* has a thickness of 40 μm.

At an outer peripheral surface of the base layer 1*a*, a heat-resistant silicone rubber layer is provided as an elastic layer 1*b*. The thickness of this silicone rubber layer may preferably be set within a range from 100 μm to 1000 μm. In this embodiment, the thickness of the silicone rubber layer 1*b* is set at 300 μm in consideration that the thermal capacity of the fixing belt 1 is decreased to shorten a warming-up time and a suitable fixation image is obtained during the fixation of the color images. The silicone rubber has a JIS-A hardness of 20 degrees and a thermal conductivity of 0.8 W/mK.

Further, at an outer peripheral surface of the elastic layer 1*b*, a fluorine-containing resin material layer (e.g., of PFA or PTFE) as a surface parting layer 1*c* is provided with a thickness of 30 μm.

On an inner surface side of the base layer 1*a*, in order to lower sliding friction between the inner surface of the fixing belt 1 and the temperature sensor TH1, a resin material layer (lubricating layer) 1*d* may be formed of a fluorine-containing resin material or polyimide in a thickness of 10-50 μm. In this embodiment, as this layer 1*d*, a 20 μm-thick polyimide layer is provided.

As a material for the metal (base) layer 1*a* of the fixing belt 1, in addition to nickel, an iron alloy, copper, silver or the like is appropriately selectable. Further, the metal layer 1*a* may also be constituted so that a layer of the metal or metal alloy described above is laminated on a resin material base layer. The thickness of the metal layer may be adjusted depending on a frequency of a high-frequency current caused to flow through the exciting coil described later and depending on magnetic permeability and electrical conductivity of the metal layer and may be set in a range from 5 μm to 200 μm.

(Pressing Roller)

The pressing roller 2 (pressing rotatable member) for forming the fixing nip between itself and the fixing belt 1 has an outer diameter of 30 mm and including an iron-made metal core 2*a* having a central portion diameter of 20 mm and both end portion diameters of 19 mm with respect to the longitudinal direction, a silicone rubber layer as an elastic layer 2*b*, and a 30 μm-thick surface parting layer 2*c* of a fluorine-containing resin material layer (e.g., PFA or PTFE). The pressing roller 2 has an ASKER-C hardness of 70 degrees at the central portion with respect to the longitudinal direction. The metal core 2*a* has a tapered shape. This is because the pressure in the fixing nip between the fixing belt 1 and the pressing roller 2 is uniformized over the longitudinal direction even in the case where the pressure-applying member 3 is bent when the pressing roller 2 presses the fixing belt 1.

In this embodiment, the width of the fixing nip N between the fixing belt 1 and the pressing roller 2 with respect to a rotational direction is, at a fixing nip pressure of 600N, about 9 mm at the both end portions of the fixing nip N and about 8.5 mm at the central portion of the fixing nip with respect to the longitudinal direction of the fixing nip N. This has the advantage such that the conveyance speed of the recording material P at the both end portions is higher than that at the central portion to decrease the likelihood of the occurrence of a crease in the paper passing through the nip.

(Pressure-Applying Member)

FIG. 5 is a sectional front view of the fixing device as the image heating apparatus in this embodiment. As described above, the left and right fixing flanges 10 as the preventing member (regulating member) for preventing (regulating) longitudinal movement of and circumferential shape of the fixing belt 1 are provided. The pressing-down force is applied to the stay 4 by compressedly providing the stay urging spring 9*b* between the device chassis-side spring receiving member 9*a* for the stay and each of end portions of the stay 4 inserted and provided into the fixing flanges 10.

As a result, the lower surface of each fixing flange 10 and the upper surface of the pressing roller 2 form the fixing nip N with a predetermined width by causing the fixing belt 1 to press-contact the pressing roller 2. Thus, it is possible to prevent the elastic layer of the pressing roller 2 and the fixing belt 1 from being deformed. The pressure-applying member 3 applies the pressure between the fixing belt 1 and the pressing roller 2 to form the fixing nip N and is held by the metal stay 4.

The pressure-applying member 3 is formed of a heat-resistant resin material, and the stay 4 requires rigidity in order to apply the pressure to the press contact portion and therefore is formed of iron in this embodiment. Further, the pressure-applying member 3 is close to the exciting coil 6 particularly at the end portions and at its upper surface, the magnetic (field) shielding core 5 (FIG. 3) is disposed over the longitudinal direction in order to shield the magnetic field generated in the exciting coil 6 so as to prevent the heat generation of the pressure-applying member 3.

Further, the base layer 1*a* of the rotating fixing belt 1 is formed of metal and therefore, even in the rotation state, as a means for preventing deviation (shift) in a widthwise direction, provision of the fixing flanges only for simply receiving the end portions of the fixing belt 1 suffice. As a result, there is the advantage such that the constitution of the fixing device can be simplified. Device side plates 12 for supporting the fixing belt 1 are provided, whereby the longitudinal position of the fixing belt 1 is regulated.

(Induction Heating Apparatus)

As shown in (a) and (b) of FIG. 30, the shape of the exciting coil 6 is substantially semicircular (arcuate) in cross section, and a U-turn portion at each of the longitudinal end portions similarly has also the substantially semicircular shape. Further, the exciting coil 6 uses, e.g., Litz wire as an electric wire 6× and is prepared by winding Litz wire in an elongated ship-bottom shape so as to oppose a part of the peripheral surface and side surface of the fixing belt 1. Further, an inner diameter of the coil with respect to the longitudinal direction is as shown in (b) of FIG. 30.

In this embodiment as shown in (a) and (b) of FIG. 3, the fixing belt 1 and the exciting coil 6 of the induction heating apparatus 100 are kept in an electrically insulating state by a 0.5 mm-thick mold (mold member 7*c*). A gap between the fixing belt 1 and the exciting coil 6 is constant at 1.5 mm (distance between the mold surface and the fixing belt surface: 1 mm), so that the fixing belt 1 is uniformly heated.

To the exciting coil 6, the high-frequency current of 20-50 kHz is applied. Then, the base layer 1*a*, constituted by metal, of the fixing belt 1 is induction-heated and then on the basis of a detection value of the temperature sensor TH1, the electric power to be inputted into the exciting coil 6 is controlled by changing the frequency of the high-frequency current so that the fixing-belt temperature is constant at 180° C., which is the target temperature of the fixing belt 1, thus temperature-adjusting the fixing belt 1.

The induction heating apparatus 100 including the exciting coil 6 is not disposed inside the fixing belt 1 to be heated to the high temperature, but is disposed outside the fixing belt 1, and therefore the temperature of the exciting coil 6 is less liable to become a high temperature, so that the electric resistance is also not increased, and thus it is possible to alleviate loss due to the Joule heat generation even when the high-frequency current is passed through the exciting coil 6. Further, the disposing of the exciting coil 6 outside the fixing belt 1 also contributes to the diameter (low thermal capacity) of the fixing belt 1 being small, which consequently enables the fixing belt 1 to have an excellent energy-saving property.

With respect to the warming-up time of the fixing device in this embodiment, a constitution in which the thermal capacity is very low is employed, and therefore when e.g., 1200 W is inputted into the exciting coil 6, the fixing-belt temperature can reach 160° C., which is the target temperature, in about 15 sec. As a result, a heating operation during stand-by is not needed and therefore electric power consumption can be suppressed at a very low level.

(Movement of Outside Magnetic Core)

As shown in FIG. 6, outside magnetic cores 7*a* and 7*b* are arranged in the direction perpendicular to the recording-material conveyance direction and are configured to partly surround the winding central portion of the coil 6 and the periphery of the coil 6. The outside magnetic core 7*a* is located in an area E present at each of the sheet-passing end portions and is, as shown in FIG. 9, movable in an arrow direction by a core moving mechanism 102*a*. Here, the control circuit portion 102 and the core moving mechanism 102*a* constitute a first moving means.

Further, the core 7*b* is located in a sheet-passing central area D and is fixed to a housing. Incidentally, the area D has a sheet-passing-area width corresponding to a small-sized paper width, and the sum of the widths of the areas E and the area D is a sheet-passing-area width corresponding to a large-sized paper width.

The outside magnetic cores 7*a* and 7*b* have the function of efficiently guiding AC magnetic flux generated by the coil 6 to the fixing belt 1. That is, the outside magnetic cores 7*a* and 7*b* are used for increasing the efficiency of a magnetic circuit (magnetic path) and for magnetic shielding. As a material for the outside magnetic cores 7*a* and 7*b*, ferrite or the like having high magnetic permeability and low residual magnetic flux density may preferably be used.

In order to avoid a non-sheet-passing-portion temperature rise with respect to various paper sizes such as those of a post card, A5, B4, A4, A3+, in each of the areas E at the sheet-passing end portions, the outside magnetic core 7*a* is divided into a plurality of outside magnetic core portions with respect to a direction perpendicular to the recording-material conveyance direction. As shown in (b) of FIG. 3, in the non-sheet-passing area, the outside magnetic core 7*a* is moved in a direction in which the outside magnetic core 7 is spaced from the coil 6 to weaken the density of the magnetic flux passing through the fixing belt 1. As a first magnetic-flux adjusting means for moving the outside magnetic core 7*a* at the end portion position, depending on a change in recording-material size with respect to the direction perpendicular to the recording-material conveyance direction, any moving mechanism may be used. For example, a link member 75 (FIG. 21) described later is used.

In this embodiment, the width of the outside magnetic core 7*a* with respect to the direction perpendicular to the recording-material conveyance direction is 10 mm. Corresponding to the recording-material size, the outside magnetic core 7*a* is moved, so that the temperature rise at the non-sheet-passing portion is suppressed. An effect by the movement of the outside magnetic core 7*a* in the case where the recording material with the width A is subjected to the sheet passing is shown in FIGS. 7 and 8. FIG. 7 shows a fixing-belt, longitudinal-temperature distribution on the first sheet (broken line) and a 500-th sheet (solid line) in the sheet passing in the case where the width A of the recording material is less than a width B in which the magnetic flux is strengthened by the outside magnetic core 7*a*.

According to this temperature distribution, when a uniform temperature distribution on the first sheet is intended to be obtained in the sheet-passing area, it is understood that the temperature of the fixing belt 1 at the paper end portion with respect to the 500-th sheet is 270° C. and thus is considerably increased. This overheating causes endurance rupture and therefore it is essential to reduce the degree of the overheating. Next, FIG. 8 shows a fixing-belt, longitudinal-temperature distribution on the first sheet (broken line) and a 500-th sheet (solid line) in the sheet passing in the case where the width A of the recording material is equal to the width B in which the magnetic flux is strengthened by the outside magnetic core 7*a*.

According to this temperature distribution, even on the 500-th sheet, a level of the overheating at the recording-material end portion is 220° C. which is not more than an endurance limit temperature of the fixing belt 1. However, both on the first sheet and the 500-th sheet, a temperature fluctuation of 10° C. or more is found at the end portions of the sheet-passing area. This leads to such a result that a sufficient heat amount cannot be supplied to the toner to induce low-temperature offset.

(Magnetic Flux Adjusting Member)

Therefore, in order to prevent the above-described overheating at the recording-material end portions and also to prevent the temperature fluctuation at the recording-material end portions, as shown in FIG. 9, a magnetic flux shielding member 11 as a magnetic flux adjusting member is made movable toward the longitudinal end portion by a moving mechanism 102*b*. As a result, a longitudinal density distribution of the magnetic flux acting on the fixing belt 1 can be changed. The control circuit portion n102 and the moving mechanism 102*b* constitute a second moving means.

A material for the magnetic flux shielding member 11 may be non-magnetic metal such as aluminum, copper, silver, gold or brass or its alloy or may also be a high-permeability material such as ferrite or permalloy. Further, it would be considered that the magnetic flux shielding member 11 is disposed between the exciting coil 6 and the outside magnetic core 7*a*, between the exciting coil 6 and the fixing belt 1 or between the fixing belt 1 and the magnetic (field) shielding core 5.

In this embodiment, as shown in FIG. 9, a copper plate was used as the magnetic flux shielding member 11 and was inserted between the exciting coil 6 and the outside magnetic core 7*a*. As an effect of the copper plate insertion, an effect of lowering the heat-generation amount of the base layer 1*a* of the fixing belt 1 by weakening the magnetic flux by the movement of the core and it is possible to control the longitudinal heat-generation distribution finely, with a width less than the width of each of the divided portions of the outside magnetic core 7*a*, by moving the copper plate in interrelation with the moving mechanism for the outside magnetic core 7*a*. The thickness of the copper plate used is 0.5 mm which is not less than a skin depth.

The magnetic flux shielding member 11 is disposed at each of the longitudinal end portions of the fixing belt 1. The longitudinal width X (with respect to the direction crossing the recording-material conveyance direction) of the magnetic flux shielding member 11 disposed at each end portion is not more than a width allowing the magnetic flux shielding member 11 to be able to be disposed at a differential position located between the device side plate 12 of the fixing belt 1 and an inner diameter portion longitudinal end of the exciting coil 6. This is based on three reasons, e.g., to provide a sufficient width in which a magnetic-flux shielding effect is achieved, to not decrease the maximum heat-generation width corresponding to the maximum size of the sheet subjected to the sheet passing, and to dispose the magnetic flux shielding member 11 without enlarging the longitudinal width of the fixing device.

The sufficient width in which the magnetic-flux shielding effect is achieved is, as shown in FIG. 10, defined as being not less than the width of the outside magnetic core 7*an* since a temperature-rise reducing effect at the recording-material end portions becomes small when the (sufficient) width is less than the width of the outside magnetic core 7*a*.

Next, an arrangement in which the maximum heat-generation width is not decreased and the longitudinal width of the fixing device is not enlarged is explicitly shown in FIG. 11. FIG. 11 shows the maximum heat-generation widths in the case where there is no magnetic flux shielding member 11, the case where the magnetic flux shielding member 11 is disposed at the differential position between the device side plate 12 and the inner diameter portion longitudinal end of the exciting coil 6, and the case where the width of the magnetic flux shielding member 11 is greater than the width of the differential position.

According to FIG. 11, in the case where the magnetic flux shielding member 11 is disposed at the differential position between the device side plate 12 and the inner diameter portion longitudinal end of the exciting coil 6, compared with the case where the magnetic flux shielding member 11 is not so disposed, the maximum heat-generation width is not substantially changed. On the other hand, in the case where the width of the magnetic flux shielding member 11 is greater than the width of the differential position, it is understood that the maximum longitudinal-generation width is narrowed. As a result, during the sheet passing of the maximum-sized paper (sheet), the magnetic flux shielding member 11 is disposed at an initial position A1 in which the magnetic flux shielding member 11 is in a state in which it is located at the differential position between the device side plate 12 and the inner diameter portion longitudinal end of the exciting coil 6.

(Effect by Magnetic Flux Shielding Member)

In order to substantiate the effect of the insertion of the magnetic flux shielding member 11 in this embodiment, study was actually made in this embodiment. A condition was such that 500 sheets of A4-sized paper (basis weight: 105 g/m$^2$) was subjected to sheet passing at 80 ppm in an environment of 15° C. The longitudinal widths of each outside magnetic core 7*a* and the magnetic flux shielding member 11 are X1 and Y1, respectively. A target (control) temperature is 180° C. at an central portion of the fixing belt 1, and an endurance rupture temperature of the fixing belt 1 is 230° C. at an inner surface of the fixing belt 1. When the fixing-belt temperature is higher than the endurance rupture temperature, a passable sheet number in an endurance test is considerably decreased.

FIG. 12 is a schematic view for illustration a relationship between an insertion position of the magnetic flux shielding member 11 at one end portion and the temperature at the recording-material end portion. When the magnetic flux shielding member 11 is inserted to the recording-material end portion, the temperature fluctuation (lowering) occurs in the sheet-passing area. On the other hand, at the insertion position more spaced from the recording-material end position to the outside position, the temperature-rise reducing effect is lowered. The position in which both of these problems can be avoided (solved) is taken as a proper position but is irrespective of the environment, the paper type, productivity and the like and therefore the position can be set at an initial setting position.

In this embodiment, the degree of the temperature rise at the recording-material end portion can be most decreased at a position, in the proper area, located outside the recording-material end position by X1/2 and therefore the magnetic flux shielding member 11 is inserted by setting this position as a proper position Z1. That is, in FIG. 12, when left-hand four magnetic cores are retracted as a first magnetic core in the non-sheet-passing area, the magnetic flux shielding member 11 is moved without retracting a second magnetic core (the fifth magnetic core from the left-hand end) adjacent to the first magnetic core. Specifically, the magnetic flux shielding member 11 is moved to the position (Z1) corresponding to the second magnetic core.

Thus, with respect to the widthwise direction of the recording material, an area which is located outside the recording-material end and which is capable of ensuring the providing of an area in which the magnetic core, which is not retracted with a predetermined width from the recording-material end, opposes the fixing belt, and at an outside thereof, the magnetic flux shielding is disposed.

FIG. 13 shows a longitudinal temperature distribution, in the case where there is no magnetic flux shielding member 11 (solid line) and the case where the magnetic flux shielding member 11 is inserted to the proper position Z1 (dotted line), after the sheet passing of 500 sheets. In the case where there is no magnetic flux shielding member 11, the fixing-belt temperature at the recording-material end position was increased up to 270° C. However, by using the magnetic flux shielding member 11, it is understood that the degree of the temperature rise at the recording-material end position is alleviated (reduced) to 200° C. and thus is largely reduced.

However, when the magnetic flux shielding member 11 is always located at this insertion position of the magnetic flux shielding member 11, a sufficient longitudinal heat-generation width in fixing of A4-sized paper for the first sheet subjected to the sheet passing cannot be obtained and therefore the magnetic flux shielding member 11 is retracted to a position B1 (FIG. 12) located outside the recording-material end position in the initial stage of the sheet passing. When the sheet passing is continued, the fixing-belt temperature is increased at the recording-material end position and therefore the magnetic flux shielding member 11 is inserted to the proper position Z1 (FIG. 12) when the temperature is increased to some extent. The temperature rise at the recording-material end portion is principally determined by productivity and therefore with respect to timing of movement of the magnetic flux shielding member 11, a table in which some cases are separately defined is prepared and then movement control is effected with a predetermined number of sheets subjected to the sheet passing.

This table is shown in Table 1.

TABLE 1

| | | | |
|---|---|---|---|
| Productivity (ppm) | 80 | 40 | 26 |
| Sheet number*[1] (sheets) | 10 | 20 | 30 |

*[1]"Sheet number" represents a movement start sheet number.

Under the condition of a 15° C. environment, A4-sized paper (basis weight: 105 g/m$^2$) and 80 ppm in this embodiment, on the 10-th sheet, the magnetic flux shielding member 11 is moved from the retracted position B1 to the proper position Z1. This is because at the time before the sheet number reaches 10 sheets, the temperature fluctuation in the sheet-passing area is induced when the magnetic flux shielding member 11 is moved and because the fixing-belt temperature at the recording-material end position is increased and exceeds the endurance rupture temperature when the magnetic flux shielding member 11 is moved at a later time than the above time. The procedure of these steps is summarized in a flow chart shown in FIG. 14.

Further, as shown in Table 2 below, when a sheet-passing endurance test was actually conducted, the magnetic flux shielding member 11 was inserted to the proper position Z1 after a proper sheet number. In the case where there was no magnetic flux shielding member 11, on the endurance sheet number of 100 K (100×10$^3$) (sheets), creases occurred on the surface layer of the fixing belt and an image defect was observed. On the other hand, in the case where there was the magnetic flux shielding member 11, even on the endurance sheet number of 300 k (sheets) or more, a good image was obtained.

TABLE 2

| Countermeasure | Endurance sheet number (sheets) 1k | 10k | 100k | 300k | 500k |
|---|---|---|---|---|---|
| None*1 | x | x | x | x | x |
| C.M*2 | ○ | ○ | ○ | ○ | ○ |
| C.M.C.I*3 | ○ | ○ | ○ | ○ | ○ |

*1"None" represents that no countermeasure was taken.
*2"C.M" represents that the outside magnetic core was moved.
*3"C.M.C.I" represents that the magnetic core was moved and the copper plate was inserted.

Second Embodiment

In this embodiment, with respect to the recording material with a size smaller than A4 size, the first and second magnetic-flux adjusting means are used. Specifically, with respect to a recording material A with a width which is 10 mm shorter than that of the A4-sized paper with respect to the direction crossing the conveyance direction, the magnetic flux shielding member 11 is inserted during the sheet passing. Incidentally, portions having the same function as those in First Embodiment will be described by using the same reference numerals or symbols.

First, when a sufficient longitudinal heat-generation width is intended to be obtained on the first sheet in sheet passing, as shown in FIG. 15, it is understood that the fixing-belt temperature is 290° C., which considerably exceeds the endurance rupture temperature at the recording-material end (corresponding) portions of the fixing belt. A result that a degree of this temperature rise is intended to be reduced by the movement of the magnetic flux shielding member 11 is shown in FIG. 16. Even when the cross of the outside magnetic core 7*a* including further inside cores are moved, it is understood that the fixing-belt temperature is increased up to 250° C., at the recording-material end portions, which has exceeded the endurance rupture temperature.

Even when the outside magnetic core 7*a* including the further inside cores is moved, similarly as in First Embodiment, the temperature fluctuation is induced at the recording material sheet-passing area end portions, so that both of the temperature-rise-degree reduction at the recording-material end portions and the temperature-fluctuation prevention at the sheet-passing-area end portions cannot be realized. Therefore, the magnetic flux shielding member 11 is inserted but as shown in FIG. 17, is inserted to a position, outside the recording material end by X1/2, which is a most proper position also during the sheet passing of the recording material A similarly as during the sheet passing of the A4-sized paper.

By inserting the magnetic flux shielding member 11 to this position, as shown in FIG. 18, it is understood that there is no temperature fluctuation at the sheet-passing-area end portions and that the fixing-belt temperature at the recording-material end positions is 200° C., and thus the degree of the temperature rise can be reduced. Also in this embodiment, similarly as in First Embodiment, the endurance (enable) sheet number was 300 k (sheets) or more by using the magnetic flux shielding member 11, so that a result of remarkable improvement was obtained. That is, with respect to the endurance-sheet-passing sheet number in which the sheets are passable with no breakage of the fixing belt, a status in which the image defect occurred on 80 k (sheets) in the case where the fixing-belt temperature was 290° C. at the recording-material end positions was considerably improved.

Third Embodiment

In this embodiment, the movement of the outside magnetic core 7*a* and the movement of the magnetic flux shielding 11 are constituted (effected) by a single driving source (motor M). FIG. 19 is a perspective view of the fixing device in this embodiment, (a) and (b) of FIG. 20 are top plan views of the fixing device in this embodiment, and (a) and (b) of FIG. 21 are sectional views of the fixing device in this embodiment. With respect to the image forming apparatus, the fixing device, the fixing belt, the pressing roller, the pressure-applying movement, and the induction heating apparatus in this embodiment, they are the same as those in First Embodiment and thus will be omitted from description.

As shown in FIG. 22, the outside magnetic cores 7*a* and 7*b* are arranged and disposed in the direction perpendicular to the recording-material conveyance direction and are configured to partly surround the winding central portion of the exciting coil and the periphery of the exciting coil. The outside magnetic core 7*a* is located in an area E (FIG. 6) present at each of the sheet passing end portions and is movable in an arrow direction by a core-moving mechanism described later.

Further, the core 7*b* is located in a sheet-passing central area D (FIG. 6) and is fixed to a housing. Incidentally, the area D has a sheet-passing-area width corresponding to a small-sized paper width, and the sum of the widths of the areas E and the area D is a sheet-passing-area width corresponding to a large-sized paper width.

The outside magnetic cores 7*a* and 7*b* have the function of efficiently guiding the AC magnetic flux generated by the exciting coil to the induction heat-generating member constituting the fixing belt 1. That is, the outside magnetic cores 7*a* and 7*b* are used for increasing an efficiency of a magnetic circuit (magnetic path) and for magnetic shielding. As a material for the outside magnetic cores 7*a* and 7*b*, ferrite may preferably be used.

As shown in (a) of FIG. 20, in order to avoid a non-sheet-passing-portion temperature rise with respect to various paper sizes, such as those of a post card, A5, B4, A4, A3+, in each of the areas E (FIG. 6) at the sheet passing end portions, the outside magnetic core 7*a* is divided into a plurality of outside magnetic core portions with respect to a Y direction. Further, as shown in FIG. 21, each of the outside magnetic cores 7*a* is welded and held on a core holder 77 and is accommodated in a housing 76. Incidentally, in this embodiment, the core holder 77 is provided, but may also be omitted and only the outside magnetic core 7*a* may be provided with the shape of the outside magnetic core 7*a* and the core holder 77 used in this embodiment.

Further, as shown in (a) of FIG. 21, the core holder 77 is movable in a direction in which the gap between the outside magnetic core 7*a* and the exciting coil 6 is changed, i.e., in an arrow P direction by guide of a guiding means 761 of the housing 76 while holding the outside magnetic core 7*a*. A link member 75 includes an elongated hole portion in which the link member 75 is connected with a connecting portion 771 of the core holder 77 and is rotationally movable around a rotation shaft 78. That is, when the link member 75 is rotated in an arrow Q1 direction, the core holder 77 and the outside magnetic core 7*a* are moved in an arrow P1 direction, and when the link member 75 is rotated in an arrow A2 direction, the core holder 77 and the outside magnetic core 7*a* are moved in an arrow P2 direction.

Thus, by providing the like member 75, the movement distance of the core holder 77 and the outside magnetic core 7*a* can be increased. The link member 75 is urged by an urging member 74 so as to be rotated in the Q1 direction and by a preventing member (regulating member) 73 for movement-preventing (regulating) the outside magnetic core 7*a*, the rotation of the link member 75 in the Q1 direction is prevented (regulated). Incidentally, in this embodiment, to the link member 75, the urging member 74 constituted by an elastic spring is attached. However, as a result, the urging member may only be required to move the magnetic core 7*a* in the P1 direction. Therefore, the urging member may also be attached to the outside magnetic core 7*a* or the core holder 77 or a moment may be exerted in the Q1 direction by the weight of the link member 75 itself.

As shown in (a) of FIG. 20, the preventing member 73 is connected with a pinion gear 80 and is movable in the direction perpendicular to the recording-material conveyance direction, i.e., in an arrow Y direction by rotational motion of the pinion gear 80. Further, the pinion gear 80 is connected to the motor M and is operated by a driving force of the motor M. A home position sensor 81 is a photo-interrupter and is light-blocked by a flag portion 73*a* of the preventing member 73 (at this time, the home position sensor is in an ON state).

Therefore, in the state of (a) of FIG. 19, (a) of FIG. 20 and (a) of FIG. 21, all the link members 75 are movement-prevented by the preventing member 73. FIG. 22 is a perspective view of an induction heating unit 70 as seen from the fixing belt 1 direction. As shown in FIGS. 19 and 22, the magnetic flux shielding member 11 is integrally mounted to the preventing member 73 and is movable together with the preventing member 73 in the direction perpendicular to the recording-material conveyance direction, i.e., in the Y direction. The copper plate is used as the magnetic flux shielding member 11 and is inserted between the exciting coil 6 and the fixing belt 1 so as to have a width which is not less than the width of the outside magnetic core 7*a*.

Part (a) of FIG. 23 is a longitudinal arrangement view during sheet passing of the maximum-sized paper. During the sheet passing of the maximum-sized paper (A3+ in this embodiment), the magnetic flux shielding member 11 is disposed at an initial position A1 corresponding to a position between an end surface of an inner diameter portion of the exciting coil 6 and the device side plate 12 for supporting the fixing belt 1. This initial position A1 is a home position. At this time, the home position sensor 81 is in the ON state. Therefore, at the home position, all the outside magnetic cores 7*a* are regulated (urged) in the P2 direction and the magnetic flux shielding member 11 is disposed at the initial position A1.

FIGS. 24 and 25 are a block diagram and a flow chart, respectively, in this embodiment. As shown in FIG. 24, a CPU 110 reads a signal from an operating portion provided to the image forming apparatus or from a recording-material-size inputting member 111 provided in a computer and controls the motor M on the basis of a signal of the home position sensor 81.

Next, with reference to FIG. 25, the steps of a core-movement operation will be described. When a print job is started, the CPU 110 reads an inputted value of the recording-material size from the recording-material-size inputting means 111. Then, by computation of the CPU 110, a predetermined pulse number C1 for the motor M from the home position is determined corresponding to the inputted value of the recording-material size. Then, the CPU 110 reads the input signal of the home position sensor 81 and in an OFF state, i.e., when the preventing member is not located at the home position, the preventing member 73 is moved in the Y2 direction. That is, by rotating the motor M, the preventing member 73 is returned until the preventing member 73 is in the ON state.

When the home position sensor 81 is in the ON state, the motor M is rotated so that the preventing member 73 is moved in the Y1 direction. Then, when switching of the state of the home position sensor 81 into the OFF state is recognized, the motor M is moved by the predetermined pulse number C1 and thus a core-movement operation is ended, so that printing is started.

Part (b) of FIG. 20 and (b) of FIG. 21 are a top plan view and a sectional view, respectively, of the fixing device after the core-moving means in this embodiment is moved. In (b) of FIG. 20 and (b) of FIG. 21, a state of the fixing device after the core movement in the non-sheet-passing area when the recording-material size is recognized as the B4 size from the signal of the recording-material-size inputting means 111 is shown. That is, three core holders 77 (FIG. 21) at each of the longitudinal end portions are moved in the P1 direction, so that the gap between the magnetic core 7*a* and the exciting coil 6 is increased.

As shown in (b) of FIG. 20, when the movement of the preventing member 73 in the Y1 direction is started, from the link members 75 at the end sides with respect to the direction perpendicular to the recording-material conveyance direction, the movement prevention is released. That is, when the preventing member 73 is moved from the end-portion side toward the central-portion side, the movement prevention is released from the magnetic cores 7*a* located at the end-portion side. Thus, by moving the preventing member 73 toward the central portion during the small-sized sheet passing, the movable range of the preventing member 73 is not enlarged in the direction perpendicular to the recording-material conveyance direction.

The state of the outside magnetic core 7*a* released from the movement prevention by the preventing member 73 will be described with reference to (b) of FIG. 21. The link member 75 released from the movement prevention by the preventing member 73 is rotated by the urging member 74 in the Q1 direction about the rotation shaft 78. Then, the link member 73 abuts against an abutting portion of a frame 79, so that the position of the link member 75 is regulated. Correspondingly thereto, the core holder 77 and the magnetic core 7*a* are moved in the P1 direction by the guide of the guiding means 761 of the housing 76, so that the gap between the outside magnetic core 7*a* and the exciting coil 6 is increased.

On the other hand, as shown in (b) of FIG. 23, with the movement of the preventing member 73, the magnetic flux shielding member 11 is moved to the proper position Z in the recording material and portion area. Therefore, in the state as shown in (b) of FIG. 20, (b) of FIG. 21 and (b) of FIG. 23, the distance (gap) between the exciting coil 6 and the outside magnetic core 7*a* is increased and therefore an efficiency of a magnetic circuit formed, around the exciting coil 6, by the outside magnetic cores 7*a* and the induction heat-generating member is lowered, so that the heat-generation amount is lowered.

Further, the magnetic circuit formed (generated) around the exciting coil 6 in the recording-material-end-portion area is shielded by the magnetic flux shielding member 11, so that the heat generation itself of the fixing belt 1, i.e., the induction heat-generating member is suppressed. Therefore, the non-sheet-passing-portion temperature rise is avoided, with the result that abnormal temperature rise of the outside magnetic core 7*a* and the exciting coil 6 is also avoided.

On the other hand, when the preventing member 73 is moved in the Y2 direction, i.e., in the case where the preventing member 73 is returned to the home position, the preventing member 73 contacts the link member 75 to rotate the link member 75 in the Q2 direction shown in (b) of FIG. 21. At this time, the core holder 77 and the core 72 are operated in the P1 direction. That is, the state shown in (b) of FIG. 21 in cross section is transferred to the state shown in (a) of FIG. 21.

Thus, in this embodiment, the magnetic core of the outside magnetic core 7*a* and the movement of the magnetic flux shielding member 11 are constituted by the single driving source (motor M). Further, there is also no need to enlarge constituent elements such as the preventing member 73 and the like in the longitudinal direction, so that it is possible to avoid the non-sheet-passing-portion temperature rise of the recording-material sizes of various types with a space-saving constitution without making the constitution complicated.

Fourth Embodiment

In this embodiment, the image forming apparatus, the fixing device, the fixing belt, the pressing roller, the pressure-applying member and the induction heating device are the same as those in First Embodiment, and the moving means for moving the magnetic cores and the magnetic flux shielding members is the same as that in Third Embodiment, and therefore, these members or means will be omitted from description. FIGS. 26A and 26B are perspective views for illustrating this embodiment. FIG. 26A shows a state before a job start. In this embodiment, in addition to the home position sensor 81 for detecting the home position of the preventing member 73, a position detecting sensor 89 is provided.

The member 73 includes, in addition to the flag portion 73*a* where the home position sensor 81 detects the home position, a position flag portion 73*b* where the position detecting sensor 89 detects the position. The position detecting sensor 89 switches its detection signal from "ON" to "OFF" or "OFF" to "ON" by passing of a plurality of edges when the preventing member 73 is moved. Timing thereof is read by the CPU 110 and then the CPU 110 provides an operation instruction to the motor M. Incidentally, a width of switching from "ON" to "OFF" or "OFF" to "ON" is set at the same value as an interval of the outside magnetic cores 7*a*.

FIGS. 27 and 28 are a block diagram and a flow chart, respectively, in this embodiment. As shown in FIG. 24, a CPU 110 reads a signal from an operating portion provided to the image forming apparatus or from a recording-material-size inputting member 111 provided in a computer and controls the motor M on the basis of signals of the home position sensor 81 and the position detecting sensor 89.

In this embodiment, as shown in FIG. 27, the position detecting sensor 89 for detecting the position of the preventing member 73 (FIG. 26) is provided. On the basis of its detection information, the number of turns of the motor M as a preventing-member, movement-driving portion for driving the preventing member is controlled by the CPU 110.

Next, with reference to FIG. 28, the steps of a core-movement operation will be described. When a print job is started, the CPU 110 reads an inputted value of the recording-material size from the recording-material-size inputting means 101. Then, by computation of the CPU 110, a predetermined switching-pulse number C2, for the motor M, of the position detecting sensor from "ON" to "OFF" or "OFF" to "ON" is determined, on the basis of the switching of the home position sensor 81 from "ON" to "OFF", corresponding to the inputted value of the recording-material size. Then, the CPU 110 reads the input signal of the home position sensor 81 and in an OFF state, i.e., when the preventing member is not located at the home position, the preventing member 73 is, by rotating the motor M, the preventing member 73 is returned until the preventing member 73 is in the ON state. That is, the preventing member 73 is shifted toward the central-portion side with respect to the direction perpendicular to the recording-material conveyance direction and therefore the preventing member 73 is moved in the Y2 direction.

When the home position sensor 81 is in the ON state, the preventing member 73 is determined as being located at the home position, and the motor M is rotated so that the preventing member 73 is moved in the Y1 direction. Then, when switching of the state of the home position sensor 81 into the OFF state is recognized, the motor M is moved by the predetermined switching-pulse number C2 of the position detecting sensor 89 and thus a core-movement operation is stopped, so that printing is started. This state is shown in FIG. 26B.

Thereafter, when the job is started, as described in First Embodiment, there is a need to move the magnetic flux shielding member (means) 11 in order to avoid the non-sheet-passing-portion temperature rise in the recording-material-end-portion areas after the predetermined number of sheets subjected to the continuous sheet passing.

Parts (a) to (c) of FIG. 29 are illustrations showing states of the outside magnetic core 7*a* and the magnetic flux shielding member in the sheet-passing area at one side from an initial stage to a later stage of the sheet passing. In this case, the preventing member 73, which holds the magnetic flux shielding member 11, detects, by the position detecting sensor 89, an edge of the position flag portion 73*b* corresponding to the position in which the number of moved outside magnetic cores 7*a* from the initial state of the job is not changed. As a result, a reference position is detected and thereafter the motor M is moved by a predetermined pulse number C3, so that the sheet-passing job enters the later stage.

That is, during the sheet-passing job, in the case where the preventing member is moved when the magnetic flux shielding member (means) 11 is moved, the number of moved magnetic cores is controlled so as not to be changed. As a result, when the preventing member 73, which holds the magnetic flux shielding member 11, is moved during the sheet passing, the reference position for the movement position is always determined at the position flag portion 73*b*. For this reason, positional non-uniformity (variation) of the preventing member 73, moved at the initial stage and that due to thermal expansion or the like during the sheet passing, can be cancelled (eliminated). That is, positional accuracy of the magnetic flux shielding member 11 during the sheet passing is improved.

Further, the edge of the position flag portion 73*b* corresponding to the position in which the number of moved outside magnetic cores 7*a* is not changed is detected and therefore during the movement, the non-sheet-passing-portion temperature rise and improper fixing at the end portions due to the movement of the outside magnetic cores 7*a* are not induced.

Further, by providing the position detecting sensor 89 and the position flag portion 73*b* of the preventing member 73, there is no need to return the preventing member 73 to the home position in order to improve the positional accuracy, so that a lowering in productivity during the sheet passing is not caused.

Modified Embodiments

In the above, the divided outside magnetic cores 7*a* is described on the premise that the longitudinal widths of the outside magnetic cores 7*a* are equal to each other, but the present invention is not limited thereto. For example, different from the central-portion side, at the longitudinal end sides, four outside magnetic cores 7*a* enclosed by a broken line in FIG. 4 may be integrally movable with a total (connected) width thereof.

Further, in the above, the magnetic flux shielding member 11 is described as being movable in the longitudinal direction, which is the rotational axis direction of the heating rotatable member, but the present invention is not limited thereto. For example, the magnetic flux shielding member 11 is provided, as the magnetic flux shielding means, on the surface of a rotatable member having a cylindrical shape or a partly cylindrical shape (e.g., with a circumferential angle of 120 degrees), and a plurality of pairs of the magnetic flux shielding members 11 may be provided depending on the widthwise size of the recording material. Further, the rotatable member on which the magnetic flux shielding members 11 are provided, depending on the widthwise size of the recording material, is rotated by a predetermined angle corresponding to the widthwise size, so that the magnetic flux shielding members 11 can be set at a proper longitudinal position.

As described above, according to the present invention, a degree of partial overheating of the fixing member caused by a phenomenon that a magnetic flux adjusting width by the magnetic cores is not equal to the recording material width is reduced.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 281360/2010 filed Dec. 17, 2010, which is hereby incorporated by reference.

What is claimed is:

1. An image heating apparatus comprising:

a coil for generating magnetic flux;

a rotatable heat generating member, which generates heat by the magnetic flux generated from said coil, for heating an image on a recording material;

a plurality of magnetic cores provided outside said heat generating member and arranged in a rotational axis direction of said heat generating member;

first moving means for moving at least a part of said plurality of magnetic cores from a first position to a second position spaced from said coil;

magnetic flux adjusting means, movable between said magnetic cores and said heat generating member, for reducing the magnetic flux directed from said magnetic cores toward said heat generating member; and second moving means for moving, when a first magnetic core in a non-sheet-passing area of the recording material is moved to the second position by said first moving means and a second magnetic core adjacent to the first magnetic core in the non-sheet-passing area is disposed at the first position to heat the image, said magnetic flux adjusting means to a position corresponding to the second magnetic core.

2. An image heating apparatus according to claim 1, further comprising an apparatus side plate provided at each of end portions of said heat generating member with respect to the rotational axis direction, wherein a width X of said magnetic flux adjusting member with respect to the rotational axis direction is, when the distance between the apparatus side plates is A, the inner diameter of said coil with respect to the rotational axis direction is B and the width of each of said magnetic cores with respect to the rotational axis direction is C, represented by:

$$C \leq X \leq (A-B)/2.$$

3. An image heating apparatus according to claim 1, wherein the movement of the first magnetic core to the second position depends on a size change of the recording material with respect to a direction perpendicular to a conveyance direction of the recording material, and the movement of said magnetic flux adjusting member depends on the changed size of the recording material when the recording material having the changed size is subjected to sheet passing for a predetermined number of sheets.

4. An image heating apparatus according to claim 1, wherein said magnetic flux adjusting member is disposed outside an inner diameter portion of said coil with respect to the rotational axis direction during sheet passing of a recording material with a maximum size.

5. An image heating apparatus according to claim 1, further comprising a preventing member for preventing movement of the first magnetic core, wherein said preventing member prevents movement of said magnetic flux adjusting member in the rotational axis direction.

6. An image heating apparatus according to claim 5, wherein said preventing member eliminates, when said preventing member is moved from an end portion toward a central portion, the prevention of movement of the magnetic cores from the magnetic core located at the end portion.

7. An image heating apparatus according to claim 6, wherein said magnetic flux adjusting member is fixed on said preventing member.

8. An image heating apparatus according to claim 5, further comprising:

position detecting means for detecting a position of said preventing member;

a preventing member movement driving portion for moving said preventing member; and control means for controlling the number of turns of said preventing member movement driving portion on the basis of detection information of said position detecting means.

9. An image heating apparatus according to claim 8, wherein after said position detecting means detects the position of said preventing member, said preventing member movement driving portion moves said preventing member to a home position.

* * * * *